US012442292B1

(12) United States Patent
Kumbhar et al.

(10) Patent No.: US 12,442,292 B1
(45) Date of Patent: Oct. 14, 2025

(54) PULSE GENERATION OF VISCOUS FLUIDS WITH A MUD MOTOR

(71) Applicant: Halliburton Energy Services, Inc., Houston, TX (US)

(72) Inventors: Koustubh Kumbhar, Houston, TX (US); Harley Wayne Jones, II, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/679,569

(22) Filed: May 31, 2024

(51) Int. Cl.
*E21B 47/24* (2012.01)
*E21B 33/13* (2006.01)

(52) U.S. Cl.
CPC ..... *E21B 47/24* (2020.05); *E21B 33/13* (2013.01)

(58) Field of Classification Search
CPC ..... E21B 33/13; E21B 47/24; E21B 47/18
See application file for complete search history.

(56) References Cited

U.S. PATENT DOCUMENTS

| | | | | |
|---|---|---|---|---|
| 5,377,753 | A | 1/1995 | Haberman et al. | |
| 10,428,582 | B1 | 10/2019 | Anderson et al. | |
| 11,746,614 | B2 | 9/2023 | Arabnejad Khanouki et al. | |
| 2007/0187112 | A1* | 8/2007 | Eddison | E21B 31/005 166/380 |
| 2014/0182849 | A1 | 7/2014 | Kumbhar et al. | |
| 2015/0204177 | A1 | 7/2015 | Isangulov et al. | |
| 2015/0285067 | A1 | 10/2015 | Logan et al. | |
| 2017/0002634 | A1 | 1/2017 | Casey | |
| 2018/0252069 | A1 | 9/2018 | Abdollah et al. | |
| 2020/0173251 | A1 | 6/2020 | Shafer | |
| 2022/0049146 | A1* | 2/2022 | Alkhalaf | E21B 41/02 |
| 2022/0186582 | A1 | 6/2022 | Quero et al. | |
| 2023/0095193 | A1* | 3/2023 | Quero | E21B 33/165 166/387 |
| 2023/0099838 | A1 | 3/2023 | Quero et al. | |
| 2023/0228152 | A1 | 7/2023 | Riggins et al. | |
| 2023/0399911 | A1* | 12/2023 | Trinh | E21B 28/00 |
| 2024/0052730 | A1 | 2/2024 | Balasubramanian et al. | |

FOREIGN PATENT DOCUMENTS

| | | | |
|---|---|---|---|
| CN | 2693945 | 4/2005 | |
| CN | 201428423 Y | 3/2010 | |
| EP | 3655616 B1 * | 8/2022 | E21B 21/103 |

(Continued)

OTHER PUBLICATIONS

Ardyne. Next Generation Cement Thru System. Ardyne Technologies, 2023. Case Study—2023UK051. Pdf file. 2 pages.

(Continued)

*Primary Examiner* — Caroline N Butcher
(74) *Attorney, Agent, or Firm* — Thomas Rooney; C. Tumey Law Group, PLLC

(57) ABSTRACT

In general, in one aspect, embodiments relate to a downhole tool assembly, that includes a rotary mechanism, a pulsing mechanism, that includes a rotary disc in mechanical communication with the rotary mechanism, where a window of the rotary disc periodically aligns with a corresponding window of the downhole tool assembly to generate a pressure pulse based on a periodicity of the rotary mechanism, and a discharge port configured to discharge fluid as the fluid is being pulsed by the pulsing mechanism.

20 Claims, 13 Drawing Sheets

(56) References Cited

FOREIGN PATENT DOCUMENTS

| | | | |
|---|---|---|---|
| WO | 1997044565 | | 11/1997 |
| WO | 2008007066 | | 1/2008 |
| WO | 2015066804 | A1 | 5/2015 |
| WO | 2018224819 | | 12/2018 |
| WO | 2020185229 | A1 | 9/2020 |
| WO | 2020246959 | A1 | 12/2020 |

OTHER PUBLICATIONS

Ardyne. Leading Technology From Leading Providers. Ardyne Technologies, 2023. Case Study—2023NOR049. Pdf file. 2 pages.
Archer. Product Sheet for Stronghold Barricade System Permanent Caprock Integrity. Archer Ltd., 2021. PDF file. 1 page.
Archer. Stronghold Barricade System Permanent Caprock Integrity—The Industry Challenge. Archer Ltd., 2018. PDF file. 2 pages.
HydraWell. "HemeraPoseidon PWC System." HydraWell Company Website, https://www.hydrawell.no/en/ hemeraposeidon. Accessed Aug. 8, 2024.
HydraWell. "HydraHemera PWC System." HydraWell Company Website, https://www.hydrawell.no/hydrahemera. Accessed Aug. 8, 2024.
HydraWell. HydraTyphon PWC System. HydraWell Company Website, https://www.hydrawell.no/en/hydratyphon. Accessed Aug. 8, 2024.
HydraWell. "HydraCT PWC System." HydraWell Company Website, https://www.hydrawell.no/en/hydract. Accessed Aug. 8, 2024.
HydraWell. "HydraWash PWC System." HydraWell Company Website, https://www.hydrawell.no/hydrawash. Accessed Aug. 8, 2024.
International Search Report and Written Opinion for International Patent Application No. PCT/US2024/035330 dated Feb. 19, 2025. PDF file. 9 pages.

* cited by examiner 110
202
302
302
304
304
306
308
206
304
308
210
208
302
212
310
216
314
312
218
316

PULSE GENERATION OF VISCOUS FLUIDS WITH A MUD MOTOR

BACKGROUND

When a well reaches the end of its lifetime, it should be permanently plugged and abandoned. Plug and abandonment ("P&A") operations usually involve placing a wellbore seal (e.g., cement plug) in the wellbore to seal off the well to prevent fluid communication between the formation and the surface. P&A may involve a multi-step abandonment process. For example, the wellbore is first cleaned at the location where the seal is to be placed to remove debris, scale, etc. Then, pre-existing casing within the wellbore (e.g., near the surface) is perforated at a target depth to temporarily allow fluid communication between the formation and the wellbore through the perforations. The wellbore and casing at the target depth may further be conditioned for scaling, and then the highly viscous sealing material (e.g., cement) is installed to permanently seal the wellbore for abandonment.

In operation, each of these steps of the multi-step abandonment process is typically implemented with a separate run into the wellbore. For example, each of the steps may involve a different tool placed at the end of a jointed pipe (or coiled tubing whichever the case may be) and a different process associated with the individual step. Between the steps, the tool may be removed from the wellbore and replaced with a tool associated with a subsequent step of the abandonment process. Inserting and removing tools into and from the wellbore may be repeated multiple times until the abandonment process is completed. Additionally, some abandonment techniques may involve leaving or otherwise abandoning tool components downhole within the wellbore, and some of the abandonment techniques may require the use of jointed pipe (or coiled tubing) for deployment of the tools.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1A:
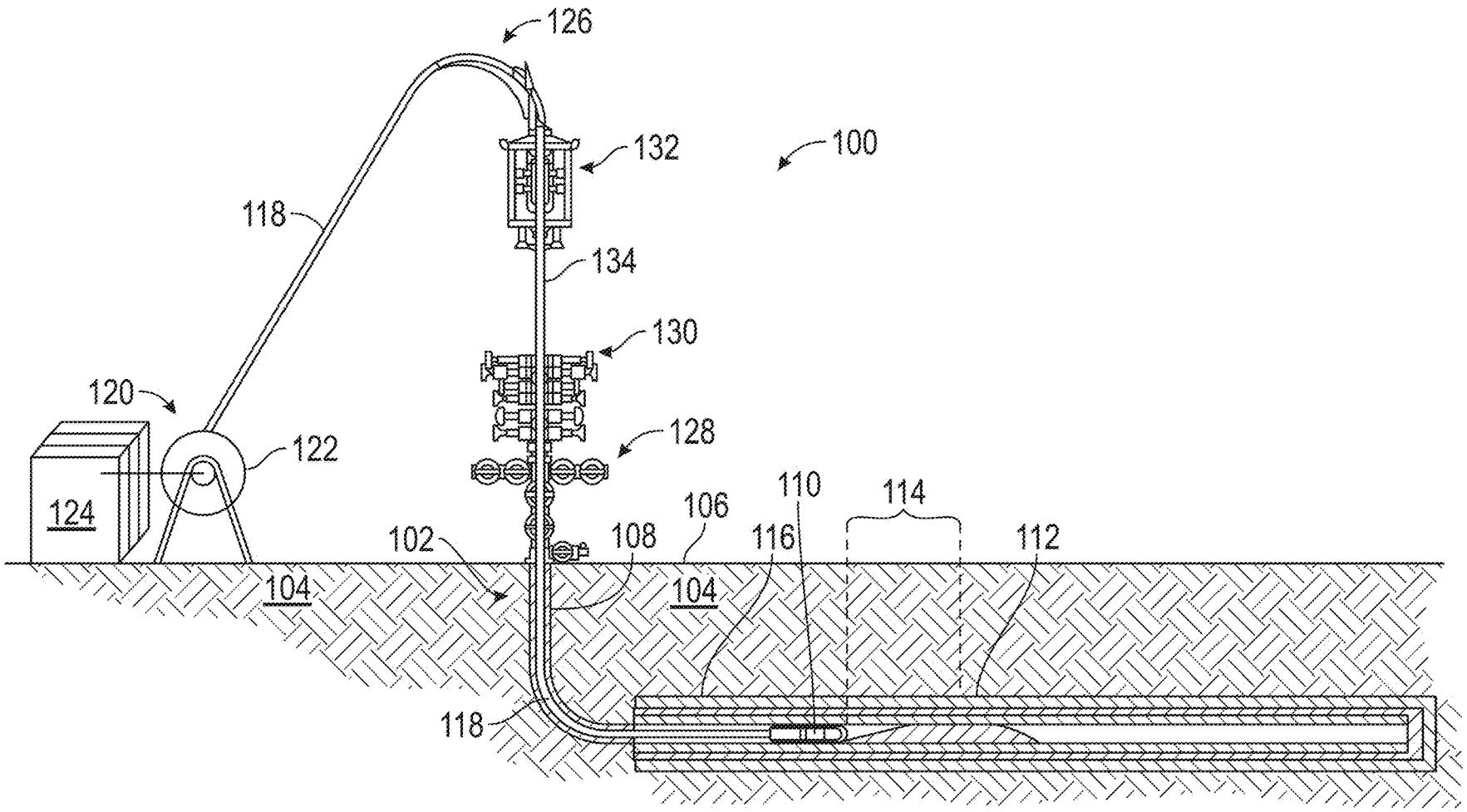
FIG. 1A shows a cross-sectional schematic view of an example of a wellbore environment 100, in accordance with certain embodiments of the present disclosure.

Embodiments of the present disclosure relate to systems and methods for preparing an oil and gas wellbore for abandonment. More specifically, though not exclusively, certain embodiments of the present disclosure relate to systems and methods that prepare the wellbore for sealing, and thereafter, seal the wellbore in a single trip within the wellbore.

In one or more embodiments, a downhole tool assembly includes a wash tool and a pulsing tool. The wash tool prepares a target interval within the wellbore for installation of a cement plug by cleaning perforations previously created in a well casing of the wellbore by a perforating tool. Once the perforations have been cleaned, the pulsing tool may be used to deposit a seal (e.g., cement plug) at the target interval in a manner that prevents unwanted communication of fluids between the formation surrounding the wellbore and/or a portion of the wellbore and a surface of the wellbore. As described in accordance with certain embodiments of the present disclosure, the disclosed downhole tool assembly is capable of performing the wash operation and the plugging operation in a single trip within the wellbore.

Further, the downhole tool assembly uses the combination of a positive displacement motor, pulse generating rotary discs, and pressure activated discharge ports to generate high amplitude and low frequency cement pulses that help the cement to permeate the target region and effectively seal off the area. Advantageously, the downhole tool may not rely on pipe rotation, ball drop activation, or complex downhole electronics and associated electrical system to pulse the cement, and the positive displacement motor (e.g., mud motor) may supply the high pressure (e.g., between 800 pounds per square inch (psi) and 6000 psi, or any ranges therebetween) needed to pulse the cement.

A single trip or run into the wellbore may refer to a downhole tool performing multiple operations within the wellbore without being removed from the wellbore between individual operations. In some examples, the downhole tool assembly may include other tools that may complement the wash tool and the cementing tool, including, but limited to, tools that clean blockages from a path within the wellbore and create perforations on a casing within the wellbore, all in a single trip within the wellbore.

For example, a downhole tool assembly according to some examples may include several tools operating as a bottom hole assembly. Each of the tools of the downhole tool assembly may perform an operation associated with preparing a target interval of the wellbore for sealing or sealing the wellbore at the target interval. For example, a cleaning tool may clean the wellbore during a run-in operation to remove debris from a target interval for installation of a cement plug. A perforating tool may perforate or slot the casing within the wellbore to provide sealing communication between the cement plug and a formation surrounding the wellbore. Further, an additional cleaning tool (e.g., the wash tool) may clean perforating debris from the target interval, and a pulsing tool may provide material for a sealing plug (e.g., cement plug) to the target interval within the wellbore. These operations may be performed by a single bottom hole assembly on a single run into the wellbore. Further, the downhole tool may be delivered downhole within the wellbore using coiled tubing, which may enable installation of the cement plug within a live well.

The downhole tool assembly in accordance with certain embodiments of the present disclosure provides several advantages over the existing downhole tools for preparing a wellbore for sealing and for sealing the wellbore.

Current market solutions for P&A operations are complex, expensive and may require multiple trips into the wellbore to complete plugging of the wellbore. For example, most commercially available tools used in P&A operations have complicated designs and constructions, and thus, are expensive to manufacture. The downhole tool assembly according to certain embodiments of the present disclosure has a simple design and construction, and thus, is easy to manufacture leading to lower costs. Additionally, the downhole tool assembly is a single trip tool which further reduces costs.

Commercially available P&A tools are also slower to deploy in the wellbore and most often need expert personnel at location to run and monitor the tools. For example, most existing P&A downhole tool assemblies include a cup tool that needs to be lowered slowly in the wellbore to avoid damaging the cup tool. Further, owing to their complex design and construction, existing P&A tools need expert personnel on location to run and monitor the tools.

To the contrary, owing to a simple design and construction, the downhole tool assembly in accordance with certain embodiments of the present disclosure is faster to deploy in the wellbore. For example, in some embodiments, the downhole tool assembly does not include a cup tool and thus can be lowered relatively faster in the wellbore than existing P&A tools. Further, the simple design and construction makes the downhole tool assembly easy to operate. Thus, the downhole tool assembly requires reduced or no expert personnel at location to operate the downhole tool assembly.

Some commercially available cleaning tools use fluidic oscillator technology to create bursts of pulsating pressure waves of low viscosity fluids such as acid or brine, enabling pinpoint placement of the fluid to treat the near-wellbore area and help restore maximum injection. The fluid pulses provide higher injectivity for better penetration of the acid and brine into tight spaces within perforations to provide better cleaning. However, these cleaning tools do not work with high viscosity fluids such as cement.

Some existing cementing tools include cup packers that are designed to force cement into the perforations with high pressure only. However, relying on pressure alone to force the high viscosity cement into the perforations does not work well to inject the fluid in tiny spaces within the perforations and micro annulus in the wellbore so that the fluid occupies the tiny spaces to provide a better seal. It has been found that pulsing the cement may provide higher injectivity and penetration to the cement allowing the cement to be reliably injected into tight spaces within the perforations and micro annulus in the wellbore to provide better sealing. Without being limited by theory, it is believed the pulses temporarily disrupt the surface tension and viscosity of the cement, thereby allowing pulsed cement to enter small perforations and fractures in the perforated section of the wellbore and formation. However, existing tools do not have the capability to pulse high viscosity fluids such as cement.

The downhole tool assembly in accordance with certain embodiments of the present disclosure includes a pulsing tool that can generate low frequency and high amplitude (e.g., high pressure such as between 800 psi and 6000 psi, or any ranges therebetween) pulses of high viscosity fluids such as cement slurry to provide better injectivity and penetration of the high viscosity fluids into perforations and micro annulus within the wellbore. Advantageously, the downhole tool assembly may use a suitable rotary mechanism (e.g., a mud motor, turbine, positive displacement pump, or an electric motor, etc.) to supply the pressure pulses that are used to periodically pulse the high viscosity fluids, thereby temporarily disrupting their viscosity, and allowing them to effectively seal the target region. This may eliminate or reduce the need for a separate power or pressure source to pulse a cement slurry. Thus, the pulsing tool provides a better seal as compared to the existing sealing tools and uses a mud motor to provide the pressure pulses.

Additionally, or alternatively, in certain embodiments, the discussed downhole tool assembly provides enhanced perforation cleaning using the wash tool with a high frequency jetting system for brine or acid placement in combination with enhanced cement bond with low frequency high amplitude (e.g., high pressure) jetting system for cement placement using the pulsing tool.

Additional advantages of the downhole tool assembly in accordance with certain embodiments of the present disclosure include no requirement of pipe movement for tool activation, no requirement of ball drops for tool activation and a substantially mechanical system with little to no electronic components.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure.

FIG. 1A is a cross-sectional schematic view of an example of a wellbore environment 100, in accordance with certain embodiments of the present disclosure. When a well 102 is damaged or otherwise unusable, operations may be performed on the well 102 to either remediate the damage or to abandon the well 102. Remediating the well may involve installing cement within the wellbore to repair a damaged section of casing. The added layer of cement may maintain integrity of the damaged casing during future operations. Further, when an oil and gas well is no longer in use, plugging and abandonment (P&A) operation may be performed. Abandonment may involve ending unwanted fluid communication between a formation 104 surrounding the well 102 and a surface 106 of the well 102. To end this fluid communication between the formation 104 and the surface 106, a cement plug in sealing communication with the formation 104 may be installed within a wellbore 108 of the well 102.

A downhole tool assembly 110 (e.g., a bottom hole assembly) may be used to prepare the wellbore 108 for installation of the cement plug and also for the installation of the cement plug within the wellbore 108. For example, the downhole tool assembly 110 may include multiple tools or subs capable of performing varying operations for installation of the cement plug within the wellbore 108. In an example, the downhole tool assembly 110 may include a cleaning tool capable of cleaning debris 112 from the wellbore 108 when the downhole tool assembly 110 is run into the wellbore 108.

Figure 1B:
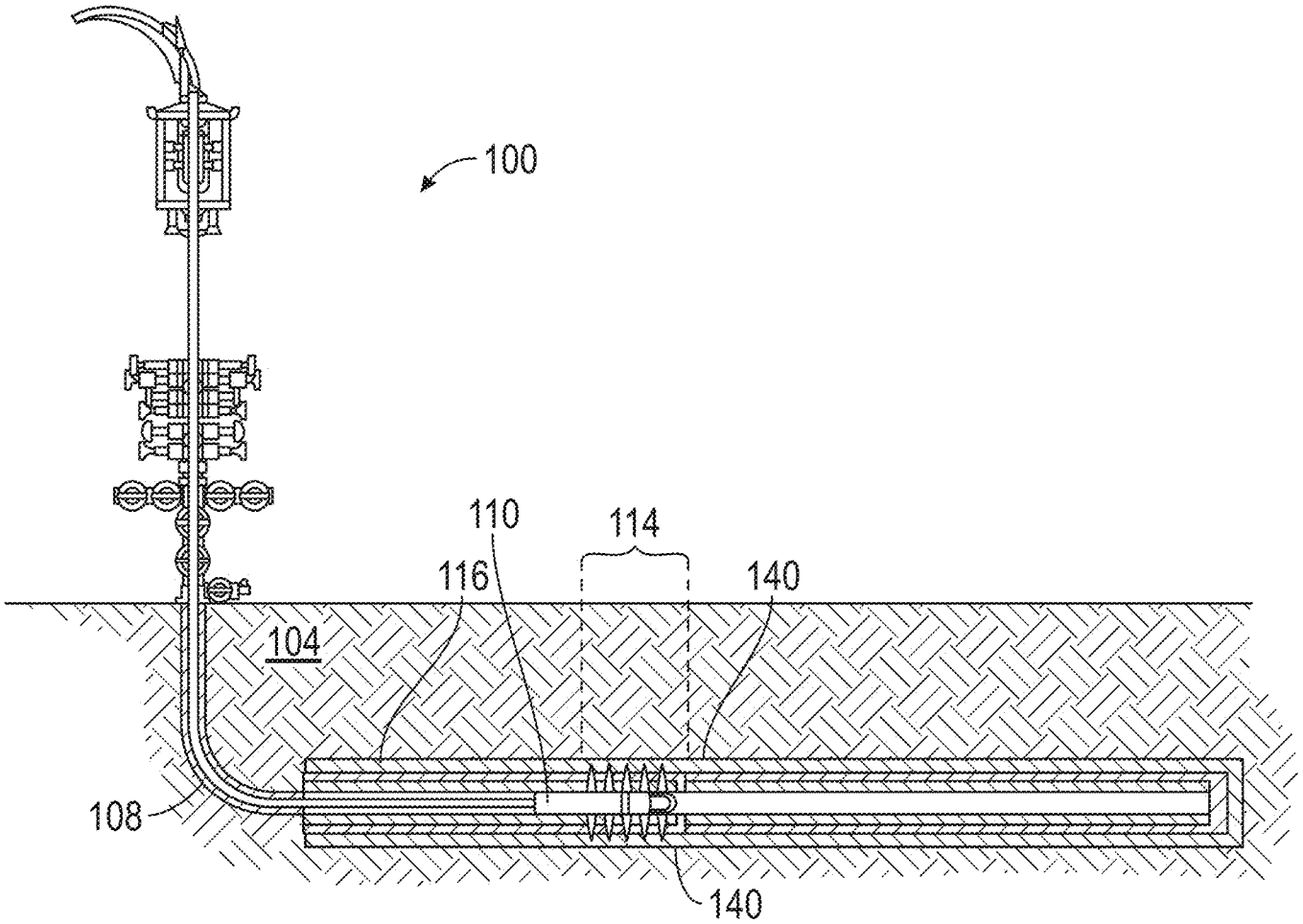
FIG. 1B shows a cross-sectional view of the wellbore environment of FIG. 1A during a perforation stage, in accordance with certain embodiments of the present disclosure.

The downhole tool assembly 110 may further include a perforating tool which, once the downhole tool assembly 110 reaches a target interval 114 of the wellbore 108, may perform a perforating or slotting operation through a casing 116 to create a path for the cement plug to achieve sealing communication with the formation 104. In an example, the target interval 114 may be a location at which the cementing plug is installed. In one example, an abrasive slurry may be pumped through the perforating tool through at least one hydraulic jet toward the casing 116 at high flow rate (e.g., greater than 3 bpm) to generate perforations or slots within the casing 116. The perforations or slots eventually enable a sealing communication between the cement plug and the formation 104. Other examples of the perforating tool may include explosive, mechanical, or chemical methods to create the perforations or slots. FIG. 1B is a cross-sectional view of the wellbore environment 100 of FIG. 1A during a perforating stage. As shown, perforations 140 have been created through the casing 116 by a perforating tool of the downhole tool assembly 110 to eventually provide sealing communication between the cement plug and the formation 104.

The downhole tool assembly 110 may further include a wash tool (e.g., wash tool 218 of FIGS. 2, 3A-3C) which, after perforating or slotting the casing 116, may clean perforation debris away from the perforations or slots 140 in the casing 116 using fluid oscillator technology. Cleaning the debris from the perforations or slots 140 in the casing 116 may prepare the target interval 114 for the cementing process associated with installing the cement plug. In an example, the wash tool may jet oscillating water, brine, spotting acid, solvent, or other cleaning agents at the target interval 114 to remove any perforating debris or material buildup away from the target interval 114. By removing the debris and buildup from the target interval 114, scaling communication between the cement plug and the formation 104 may be improved.

Figure 1C:
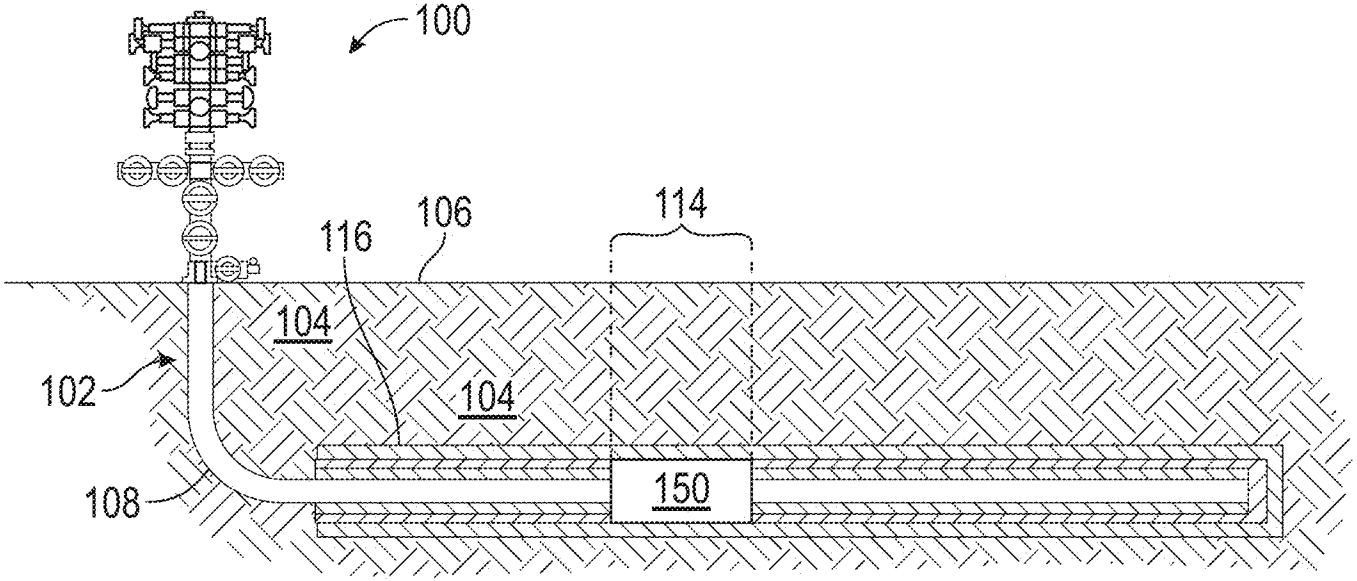
FIG. 1C shows a cross-sectional view of the wellbore environment of FIG. 1A upon completion of installation of a cement plug, in accordance with certain embodiments of the present disclosure.

The downhole tool assembly may further include a plugging tool which, after the perforations have been cleaned, may place a cement plug at the target interval 114 in sealing communication with the formation 104. In one example, one or more large flow ports of the pulsing tool may layer or otherwise place the cement for the cement plug at the target interval 114. While the cement plug is described herein as being made of cement, other suitable plugging compositions may be used, such as a sealant plug or plug made from a sealant, cement, resin, Sorel cement, epoxy, etc., or any combination thereof, may also be used. Fluid pulsed by a pulsing mechanism (e.g., pulsing mechanism 310) may therefore comprising a plugging composition, in some examples. Plugging compositions may have a high viscosity (e.g., greater than 120 centipoise). In an example, the sealant may be a hardening resin capable of creating scaling communication with the formation 104 surrounding the wellbore 108. FIG. 1C is a cross-sectional view of the wellbore environment 100 of FIG. 1A upon completion of installation of a cement plug, in accordance with certain embodiments of the present disclosure. As shown, a scaling plug 150 is installed at target interval 114 within the wellbore 108 providing scaling communication between the formation 104 and the wellbore 108.

It may be noted that while the downhole tool assembly 110 is discussed as having each of a cleaning tool, a perforating tool, a wash tool, and a pulsing tool, a skilled person may appreciate that the downhole tool assembly 110 may include any one or more of these tools and may further include additional tools to complement one or more of these tools. In general, one purpose of downhole tool assembly 110 is to clean the target interval 114 and then discharge cement to form the sealing plug 150 in a single run or use.

As illustrated in FIG. 1A, the downhole tool assembly 110 is coupled to an end of, e.g., coiled tubing 118. The coiled tubing 118 may be deployed with the downhole tool assembly 110 into the wellbore 108 using a coiled tubing system 120. In an example, the coiled tubing system 120 may include a reel 122 that stores unused coiled tubing 118 and turns to inject or retract the coiled tubing 118 within the wellbore 108. The coiled tubing system 120 may also include multiple fluid storage tanks 124. The fluid storage tanks 124 may store fluid provided by the coiled tubing system 120 to the downhole tool assembly 110 to clean the wellbore 108, to perforate or slot the casing 116, to clean debris and buildup from the slotted or perforated areas of the casing 116, to install a cement plug, or any combination thereof.

When deploying the downhole tool assembly 110 into the wellbore 108 using the coiled tubing system 120, the coiled tubing may be run through a gooseneck 126. The gooseneck 126 may guide the coiled tubing 118 as it passes from a reel orientation in the reel 122 to a vertical orientation within the wellbore 108. In an example, the gooseneck 126 may be positioned over a wellhead 128 and a blow-out preventer 130 using a crane (not shown).

The gooseneck 126 may be attached to an injector 132, and the injector 132 may be attached to a lubricator 134, which is positioned between the injector 132 and the blow-out preventer 130. In operation, the injector 132 grips the coiled tubing 118 and a hydraulic drive system of the injector 132 provides an injection force on the coiled tubing 118 to drive the coiled tubing 118 within the wellbore 108. The lubricator 134 may provide an area for staging tools (e.g., the downhole tool assembly 110) prior to running the tools downhole within the wellbore 108 when the wellbore 108 represents a high-pressure well. Further, the lubricator 134 provides an area to store the tools during removal of the tools from the high-pressure well. That is, the lubricator 134 provides a staging area for injection and removal of tools into and from a high-pressure well (e.g., a live well).

While the wellbore environment 100 is depicted as using the coiled tubing 118 to install the downhole tool assembly 110 within the wellbore 108, other tool conveyance systems may also be employed. For example, the wellbore environment 100 may include a jointed pipe system to install the downhole tool assembly 110 within the wellbore 108. Additionally, while the wellbore environment 100 is depicted as a land-based environment, the downhole tool assembly 110 may also be similarly introduced and operated in a subsea based environment.

Figure 2:
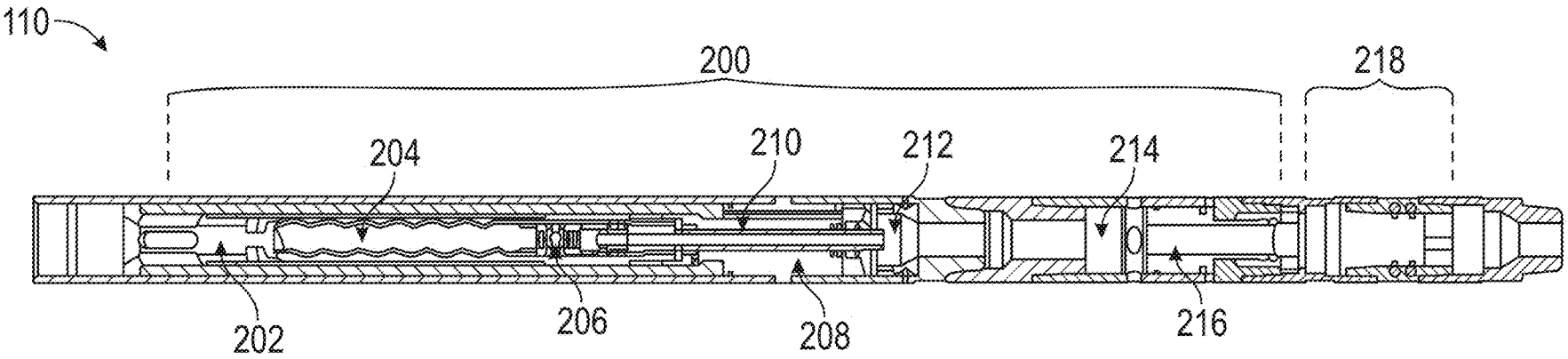
FIG. 2 shows a closer depiction of downhole tool assembly 110, in accordance with certain embodiments of the present disclosure.

FIG. 2 is a closer depiction of downhole tool assembly 110, in accordance with certain embodiments of the present disclosure. As illustrated, downhole tool assembly 110 includes a pulsing tool 200 and a wash tool 218. The purpose of pulsing tool 200 is to pulse a high viscosity fluid (e.g., cement slurry) while it is used to form a sealing plug 150 after it is introduced to the target interval 114 (e.g., referring to FIGS. 1A-1C). Through the use of cement pulses, the cement may penetrate deeper into the formation cracks, fractures, and pores to potentially improve cement bonding. As discussed, the pulsing temporarily lowers the viscosity of the fluid, thereby allowing it to better permeate the target interval 114 and form a more effective seal when it forms the scaling plug 150.

The pulsing tool 200 may comprise a fluid divider 202 positioned uphole from (e.g., connected to), or form part of, a sub containing a positive displacement motor 204. The fluid divider 202 separates a downgoing stream of fluid (e.g., cement slurry) into two or more streams. These may include, for example, a non-bypass stream (e.g., non-bypass stream 304 of FIG. 3) and a bypass stream (e.g., bypass stream 302 of FIG. 3). Any suitable number of streams and flow paths are possible. In general, however, the downhole movement of the non-bypass stream forces rotation of the positive displacement motor 204 while a bypass stream passes outside of positive displacement motor 204.

Wash tool 218 may also discharge a pressurized low viscosity wash fluid (e.g., spotting acid, brine solvent, etc.) in an oscillating fashion similar to pulsing tool 200. The purpose of wash tool 218 is to prepare the target interval 114 prior to introducing the cement plug slurry to ensure sealing plug 150 forms an effective seal.

The pulsing tool 200 includes, inter alia, a positive displacement motor 204, a rotary shaft 210, and a discharge sub 214. The positive displacement motor 204 is mechanically connected to the rotary shaft 210 by a double universal joint 206, which converts the lopsided, i.e., "wobbly" rotational movement of the positive displacement motor 204 to a simple rotation of a rotary shaft 210. In examples, rotary shaft 210 may be characterized by rotation along a single fixed axis. The simple rotation of the rotary shaft 210 ultimately allows the discharge sub 214 to emit pressure pulses through the cement slurry as it is being discharged from the downhole tool assembly 110.

The rotary shaft 210 may be positioned uphole from (e.g., disposed partially within) the merging sub 212, which merges the annular and non-bypass streams into a single merged stream. Once the streams are merged, the merged fluid passes through a merging sub 212 to a discharge sub 214, where the fluid is cyclically discharged through discharge ports (e.g., discharge ports 314 of FIG. 6), to be discussed later. Rotary shaft 210 may comprise one or more internal conduit that thereby allows the non-bypass stream to pass from the positive displacement motor 204 to the merging sub 212. Alternatively, rotary shaft 210 may be a single (e.g., solid) rotor without any conduits.

A bypass sub 208 is disposed concentrically around at least a portion of the rotary shaft 210 and is positioned between the merging sub 212 and the positive displacement motor 204. The bypass stream of fluid passes through bypass sub 208, e.g., in an area concentric to the rotary shaft 210 within the bypass sub 208. The non-bypass stream also passes separately through bypass sub 208, such as via an internal conduit of the rotary shaft 210, for example.

A shifting sleeve 216 is configured to alternate between an open and closed position. Differences in pressure, e.g., as a result of the type of fluid being pumped down through the downhole tool assembly 110 (high viscosity or low viscosity) may be used to actuate between the open and closed positions. In the open position, the discharge ports of the discharge sub 214 are closed to disallow fluid (e.g., wash fluid) from escaping out through the discharge sub 214. In the closed position, the discharge ports of the discharge sub 214 are open to allow a fluid (e.g., cement slurry) to discharge out from the discharge sub 214. This may also allow a pressure pulse to travel through the high viscosity fluid when the relevant apertures (e.g., apertures of rotary shaft 210 and stationary disc 502 of FIGS. 5A, 5B) are aligned, to be discussed in greater detail.

In use, the downgoing fluid passes through the positive displacement motor 204, causing it to rotate, as the bypass stream and non-bypass stream separately pass through the bypass sub 208 until they are merged by the merging sub 212 before being discharged out from discharge sub 214. Additionally, when the downgoing fluid is at a pressure below a threshold pressure, the shifting sleeve 216 may be open to allow the fluid to pass through wash tool 218.

Figures 3A, 3B, 3C:
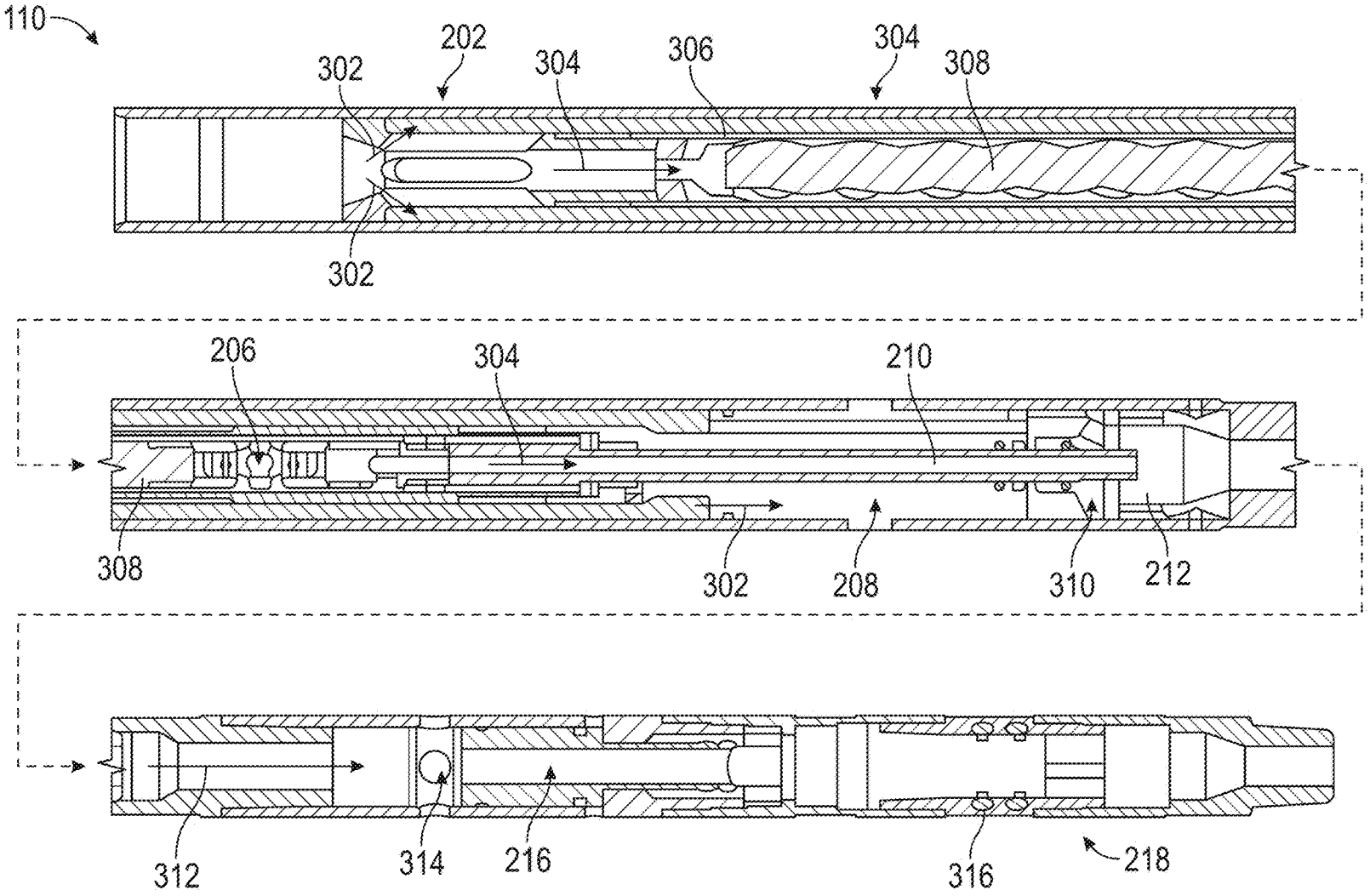
FIG. 3A shows a cross-sectional view of a portion of the downhole tool assembly showing a part of the pulsing tool that includes a fluid divider and a positive displacement motor, in accordance with certain embodiments of the present disclosure.
FIG. 3B shows a cross-sectional view of a portion of the downhole tool assembly showing another part of the pulsing tool downhole to that shown in FIG. 3A, that includes a double universal joint connected to a rotary shaft disposed within a bypass sub, and a merging sub, in accordance with certain embodiments of the present disclosure.
FIG. 3C shows a cross-sectional view of a portion of the downhole tool assembly showing another part of a pulsing tool downhole to the sections shown in FIGS. 3A and 3B, that includes a discharge sub and a wash tool downhole from the pulsing tool, in accordance with certain embodiments of the present disclosure.

FIG. 3A is a cross-sectional view of a portion of the downhole tool assembly showing a part of the pulsing tool 200 (e.g., referring to FIG. 2) that includes a fluid divider 202 and a positive displacement motor 204, in accordance with certain embodiments of the present disclosure. As mentioned, a fluid divider 202 may divide the downgoing fluid into a bypass stream 302 and a non-bypass stream 304. The bypass stream 302 is an annular stream that "bypasses" the positive displacement motor 204 because it travels outside a concentric body 306 that houses, e.g., the tortuous rotor 308 rotated by the passage of fluid of the non-bypass stream 304. The non-bypass stream may be characterized as a "central" or "non-annular" stream because it travels along a flow path radially disposed within the bypass stream 302. However, non-bypass stream 304 may also be characterized as "annular" in some regions, such as when it passes annularly along the tortuous rotor 308. In any embodiment, however, the non-bypass stream 304 does not bypass the positive displacement motor 204 but may drive the rotation of the tortuous rotor 308 within the concentric body 306. The fluid divider 202 may have any suitable shape or geometry that divides the fluid into the desired number of streams.

After being separated from the bypass stream 302 by the fluid divider 202, the non-bypass stream 304 passes through a positive displacement motor 204, thereby driving its rotation. A positive displacement motor 204 may be, in some examples, a mud motor. The purpose of positive displacement motor 204 is to provide the rotational force needed for rotating a tortuous rotor 308 to cycle between aligned and non-aligned configurations of a pulsing mechanism downhole from the positive displacement motor 204, to be discussed in later figures. The tortuous rotor 308 of the positive displacement motor 204 may thus rotate as a result of the downgoing movement of the fluid of non-bypass stream 304.

In any embodiment, an electric motor or a turbine may be used instead of the positive displacement motor 204. For example, any suitable downhole "rotary mechanism," e.g., the positive displacement motor 204, may be in mechanical communication with a rotary shaft (e.g., rotary shaft 210 of FIGS. 2, 3B) to impart rotation to a pulsing mechanism (e.g., pulsing mechanism 310 of FIG. 3B) to generate the pulses, as discussed. Where such a downhole rotary mechanism does not include a tortuous rotor 308 or otherwise does not involve wobbly rotation, this may eliminate, in some examples, the need for double universal joint (e.g., double universal joint 206 of FIGS. 2, 3B).

FIG. 3B is a cross-sectional view of a portion of the downhole tool assembly showing another part of the pulsing tool 200 (e.g., referring to FIG. 2) downhole to that shown in FIG. 3A, that includes a double universal joint 206 connected to a rotary shaft 210 disposed within a bypass sub 208, and a merging sub 212, in accordance with some embodiments of the present disclosure. As mentioned, the tortuous rotor 308 of the positive displacement motor 204 (e.g., referring to FIG. 3A) is mechanically coupled to the rotary shaft 210 by a double universal joint 206 which serves to convert the wobbly, non-simple rotation of the tortuous rotor 308 to a simple linear rotation of the rotary shaft 210 to drive the rotation of the pulsing mechanism 310.

The double universal joint 206 may be any suitable type of joint configured to convert the wobbly rotation to the simple linear rotation, as discussed. For example, a U-joint, Cardan joint, Double Cardan joint, Hooke joint, Spicer joint, Hardy Spicer joint, etc., to use non-limiting examples. As shown, the double universal joint 206 is disposed within a body of the downhole tool assembly 110 between a bypass sub 208 and the positive displacement motor 204.

A bypass sub 208 is a sub that lets the bypass stream 302 and the non-bypass stream travel downwards separately before being merged at the pulsing mechanism 310 of the merging sub 212. The rotary shaft 210—which may be a solid rotor or a rigid pipe, for example—is disposed centrally within the bypass sub 208. The non-bypass stream 304 travels in the downhole direction, e.g., annularly about the rotary shaft 210 if it is a solid rotor, while the bypass stream 302 travels separately along a different flow path through the bypass sub 208. The pulsing mechanism 310 generates pulses as it periodically merges the bypass stream 302 and the non-bypass stream 304 together, to be discussed in greater detail (e.g., referring to FIGS. 5A, 5B).

The merging sub 212 houses the pulsing mechanism 310. The bypass sub 208 may hold the bypass stream 302 behind a rotary disc (e.g., rotary disc 504 of FIGS. 5A, 5B) of the merging sub 212 until the relevant apertures of the pulsing mechanism 310 are aligned to allow flow. The sudden temporary increase in pressure due to the combined pressures of both streams creates the pressure pulse that once it reaches the edge of the high viscosity fluid, temporarily decreases its viscosity, thereby temporarily disrupting surface tension at the boundary where it intersects with a bonding surface and allowing it to permeate into microcracks in the formation and more effectively sealing off a target interval 114 (e.g., referring to FIGS. 1A-IC).

FIG. 3C is a cross-sectional view of a portion of the downhole tool assembly showing another part of the pulsing tool 200 (e.g., referring to FIG. 2) downhole to that shown in FIGS. 3A and 3B, that includes a discharge sub 214, and the wash tool 218 downhole from the pulsing tool 200, in accordance with some embodiments of the present disclosure. As shown, the discharge sub 214 is positioned downhole from the merging sub 212 and includes one or more discharge ports 314. The discharge ports 314 allow for discharge of the downgoing fluid into the region surrounding the downhole tool assembly 110 when this is employed in the wellbore. The wash tool 218 may be disposed after the discharge sub 214.

Shifting sleeve 216 is a mechanism that allows fluids to exit through the discharge ports 314. The shifting sleeve 216 may only be in the open configuration when above a threshold level of pressure. For example, certain fluids may not create enough pressure to trigger the shifting sleeve. As such, those fluids may not exit though the discharge ports 314 but may instead proceed to the wash tool 218. In another example, however, cement slurry may create enough pressure such that the threshold pressure is reached. Once this occurs, the shifting sleeve 216 will be activated to open the connected discharge ports 314. From this example, cement slurry will be discharged into the formation. Overall, as this discharge is occurring, the cement pulse periodically being generated from the merging sub 212 may pulse the discharging cement as it is being introduced into the target interval 114, thereby allowing it to better permeate into microcracks and fractures of the formation.

As mentioned, after the non-bypass stream 304 and the bypass stream 302 are combined in the merging sub 212 (e.g., referring to FIG. 3B) to form a merged stream 312, the merged stream 312 may pass to a discharge sub 214 where it is discharged through the one or more discharge ports 314 if the sliding sleeve 216 is open. If the pressure of the downgoing fluid is greater than a threshold pressure, the high viscosity (or low viscosity) fluid may be discharged from the discharge sub 214 via discharge ports 314, as later described in FIG. 6. The activation of discharge ports 314 may be caused by a shifting sleeve 216 that activates when a threshold of pressure in the fluid has been reached. In some embodiments, the threshold of pressure is reached when the fluid passing through the downhole device is cement slurry. With its density and viscosity, cement slurry is one example of a fluid that can build up enough pressure to activate the shifting sleeve 216. In some examples, the discharge sub 214 includes the shifting sleeve 216, which is designed to open the discharge ports 314 when fluid pressure inside the discharge sub 214 increases beyond a threshold pressure rating of the shifting sleeve 216.

In alternative embodiments, when the wash tool 218 has finished cleaning the perforations 140, cement slurry may be pumped into the downhole tool assembly 110. Since the sleeve 216 is closed at this point, the cement flow is unable to exit via the discharge ports 314 and proceeds to the wash tool 218 and attempts to exit via the ports of the wash tool 218 until pressure increases above the threshold pressure, at which point the shifting sleeve 216 opens.

In one or more embodiments, after a perforating or slotting operation is completed by a perforating or slotting tool, a low viscosity fluid such as brine or acid may be pumped in the flow direction of stream 312 (e.g., through the coiled tubing 118 of FIG. 1A) into the downhole tool assembly 110. The low viscosity fluid flows through the pulsing tool 200 (e.g., referring to FIG. 2) into the wash tool 218 and is diverted to one of more oscillating side ports 316 of the wash tool 218. The oscillating side ports 316 transmit fluid into the wellbore 108 in an oscillating manner to provide a thorough flush of the perforations or slots 140 (e.g., referring to FIG. 1B) cut through the casing 116. For example, the oscillating fluid may flow through the oscillating side ports 316. The fluid that flows through the oscillating side ports 316 may include any low viscosity fluid including, but not limited to a spotting acid, a solvent, or another cleaning agent to remove buildup, scale, or any other debris from within the wellbore 108, from the perforations 140 or from the formation 104. Further, the fluid flowing through the oscillating side ports 316 may place a conditioning treatment within the perforations or slots 140 (e.g., referring to FIG. 1A) to prepare the target interval 114 for subsequent material placement (e.g., installation of the cement plug). In one or more embodiments, wash tool 218 may provide the fluid with pulsating resonance as a cyclic output. For example, the cyclic output may include high frequency pulses (e.g., 100 Hz to 300 Hz, or any ranges therebetween) at low fluid pressure (e.g., between 100 psi and 800 psi, or any ranges therebetween) with a flow rate in the range of 0.25 barrels (bbl)/min and 10 bbl/min, or any ranges therebetween. In examples, the fluid pulses output by the oscillating side ports 316 of wash tool 218 may help break up any consolidated fill within the perforations or the slots 140, and the pulse and flow aspect of the cyclic output may also provide an ability to flush any fill from irregular channels or profiles of the perforations or the slots 140.

Figure 4B:
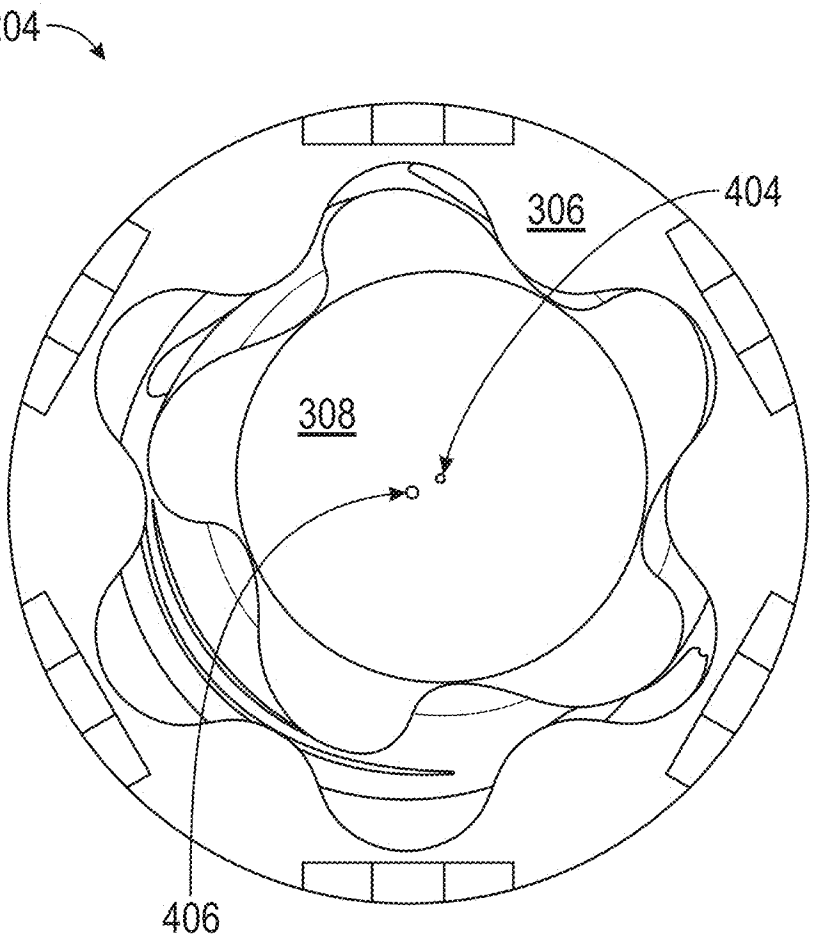
FIG. 4B shows a cross-section of the tortuous rotor of FIG. 4A, except that the cross-section is slightly uphole or downhole to the cross-section shown in FIG. 4A, in accordance with some embodiments of the present disclosure.
Figure 4A:
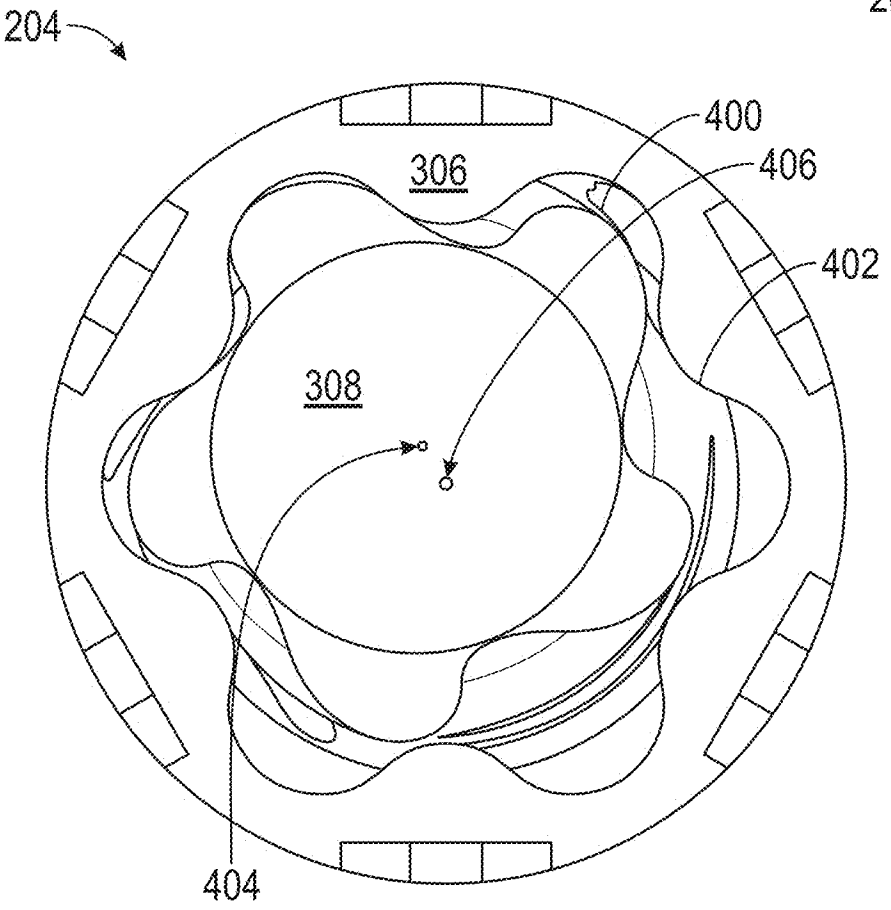
FIG. 4A shows a cross-section of a tortuous rotor of a positive displacement motor, in accordance with some embodiments of the present disclosure.

Turning back to the pulsing mechanism 310, FIG. 4A shows a cross-section of the positive displacement motor 204 of FIGS. 2 and 3A with a closer view of a tortuous rotor 308 disposed within a concentric body 306, in accordance with some embodiments of the present disclosure. For a given cross section, the center 404 ("center point") of the tortuous rotor 308 is offset from a centerline 406 of the positive displacement motor 204. Thus, the tortuous rotor 308 is configured to rotate within the concentric body 306 of the positive displacement motor 204, with the contoured outer surface 400 of the tortuous rotor 308 designed to mate with a corresponding surface 402 of the concentric body 306. As downgoing fluid of the non-bypass stream 304 (e.g., referring to FIGS. 3A-3C) passes through the positive displacement motor 204 along the tortuous rotor 308 in an open region temporarily formed between the contoured outer surface 400 and the corresponding surface 402, it forces the tortuous rotor 308 to rotate such that the center 404 of tortuous rotor 308 for a given cross section continuously orbits the centerline 406 of the positive displacement motor 204. The open region likewise winds around the centerline 406 as the tortuous rotor 308 turns.

FIG. 4B shows another cross section of the positive displacement motor 204 of FIG. 4A either slightly uphole or downhole to the cross section shown in FIG. 4A, for clarity and understanding, in accordance with certain embodiments of the present disclosure. In this view, the radial orientation of the center 404 is, while still offset from the centerline 406, oriented to the right instead of to the left, showing how the tortuous rotor 308 would therefore have a "wobbly" or "lopsided" rotation relative to centerline 406. As mentioned, this necessitates, in some examples, the need for the double universal joint 206 (e.g., referring to FIG. 2). As the non-bypass stream 304 passes through the positive displacement motor 204, it imparts rotation to the tortuous rotor 308 which is in turn transferred to the rotary shaft 210 via the double universal joint 206 (e.g., referring to FIG. 2).

Figure 5B:
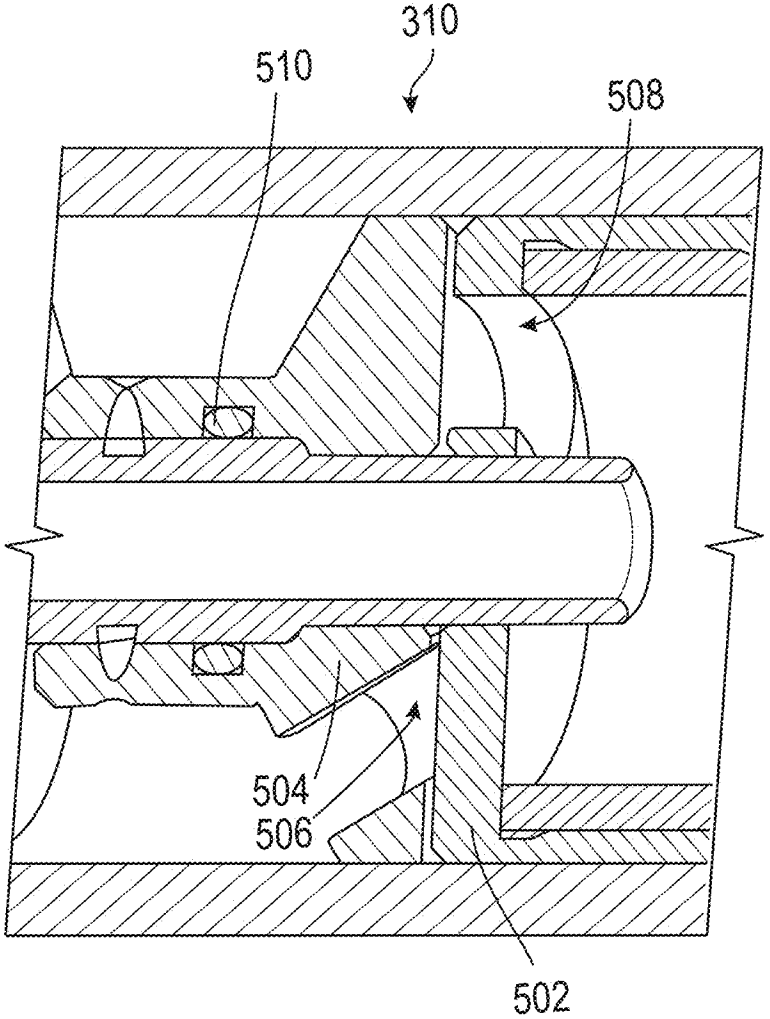
FIG. 5B shows a cross-sectional view of the pulsing mechanism of FIG. 5A with windows of the stationary disc and the rotary disk in an unaligned configuration, in accordance with some embodiments of the present disclosure.
Figure 5A:
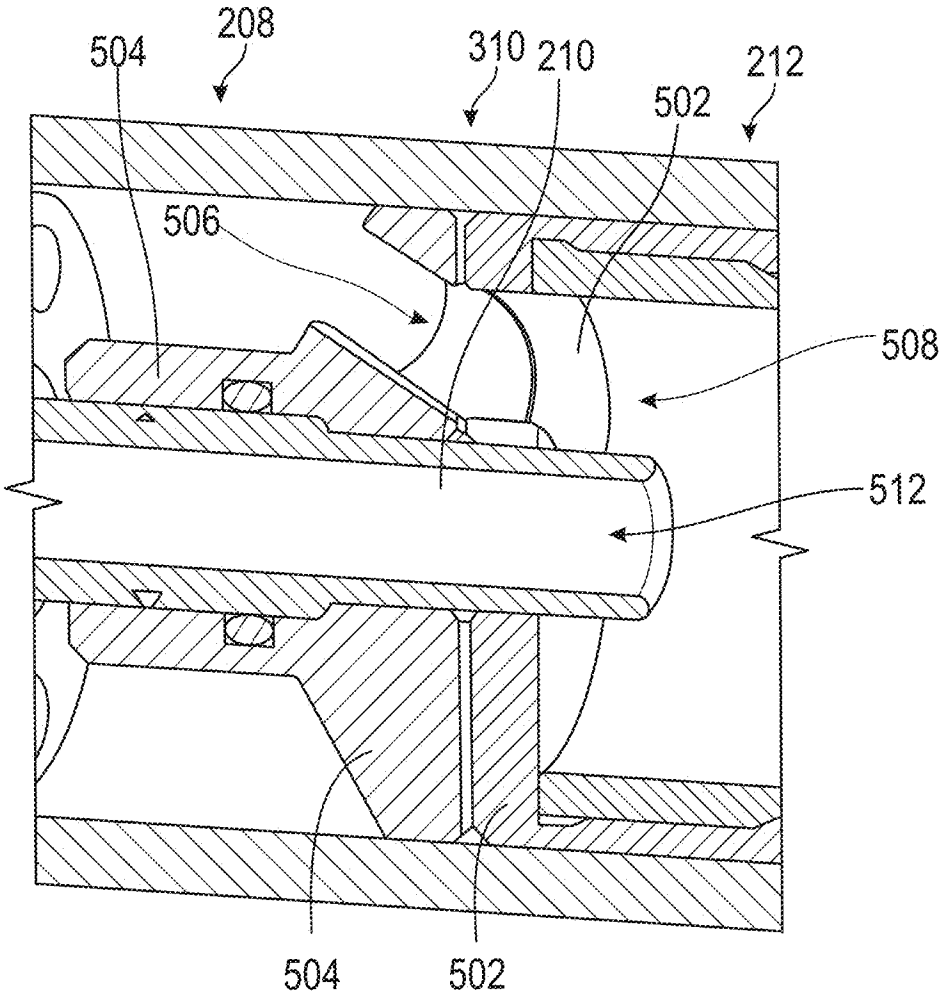
FIG. 5A shows a cross-sectional view of a pulsing mechanism with windows of the stationary disc and the rotary disk in an aligned configuration, in accordance with some embodiments of the present disclosure.

FIG. 5A shows a cross-sectional view of the pulsing mechanism 310 with the windows 506, 508 of the stationary disc 502 and the rotary disc 504 in an aligned configuration, in accordance with some embodiments of the present disclosure. Pulsing mechanism 310 comprises a stationary disc 502 and a rotary disc 504. The rotary disc 504 is fixedly attached to the rotary shaft 210, and comprises a window 506 (e.g., pass-through, port, aperture, channel, etc.). Stationary disc 502 likewise comprises a window 508 that may periodically align with window 506 due to the rotation of rotary shaft 210. As the rotation originates from the positive displacement motor 204 (e.g., referring to FIG. 2), the periodicity that is used to generate the pulses therefore originates from the passage of fluid through the positive displacement motor.

Stationary disc 502 comprises a window 508 that remains stationary during the periodic pressure pulsing with the pulsing mechanism 310. Stationary disc 502 is shown as having a single window (e.g., window 508) but may comprise a plurality, in some examples. Window 508 of stationary disc 502, as well as a corresponding window 506 of a rotary disc 504, may be custom window cutout(s) that allow the bypass stream 302 from the bypass sub 208 to periodically communicate with the region outside the downhole tool assembly 110 (e.g., referring to FIG. 1B) when they are aligned. Stationary disc 502 controls the flow rate of the bypass stream 302 through the merging sub 212 when rotary disc 504 periodically aligns with it. As the rotary disc 504 rotates, the custom window cutout of the rotary disc 504 aligns with the custom window cutout of the stationary disc 502 to allow a flow path for fluid. Prior to the alignment, fluid from the bypass stream 302 (e.g., referring to FIG. 3A) may not pass through the two discs. As such, the fluid is held in the bypass sub 208 until alignment occurs. As this process of controlling the flow rate of fluid occurs, cement pulses are generated when alignment occurs and the bypass stream of fluid merges with the non-bypass stream 304 of fluid in the merging sub 212. This figure also shows an inner conduit 512 of rotary shaft 210, previously mentioned, which may allow the non-bypass stream 304 from the positive displacement motor 204 to communicate with the merging sub 212. A total flow rate of the fluid (e.g., cement) through the merging sub 212 may be, for example, dependent upon a constant value set by one or more surface pumps. For example, between 1 and 3 barrels per minute (bpm), or any ranges therebetween. Window 508 controls the minimum pressure drop through stationary disc 502. As the rotary disc 504 reduces the flow area/opening (during non-alignment), an increased pressure drop is generated which yields an increase of pressure.

A rotary disc 504 is a disc that rotates around the rotary shaft 210. As with the stationary disc 502, the rotary disc 504 may have one or more custom window cutouts to allow the flow path of the bypass stream of fluid from the bypass sub 208. In some embodiments, the window opening size and shape can be adjusted to modify or maximize pulse magnitude at a given flow rate. For example, larger windows may affect the amplitude of a compression wave. Furthermore, the number of windows may also affect the pulse rate and thus the amplitude, as can the rotation speed of the rotary shaft 210, which is fixedly coupled to the rotary disc 504. In general, the rotary shaft 210 is not coupled to the stationary disc 502, however, but freely rotates within pulsing mechanism 310.

FIG. 5B shows a cross-sectional view of the pulsing mechanism 310 with the windows 506, 508 of the stationary disc 502 and the rotary disc 504 of FIG. 5A in an unaligned configuration, in accordance with some embodiments of the present disclosure. As shown, pressure may build up at the region indicated at 506 due to the impasse created by the nonalignment of the stationary disc 502 and the rotary disc 504. This built-up pressure is discharged periodically each time the windows 506 and 508 align. The pressure of bypass stream 302 (e.g., referring to FIG. 3B) may therefore asymptotically approach that of a downgoing fluid that originally enters fluid divider 202 (e.g., referring to FIG. 3A). Rotation rate of rotary shaft 210 may also affect the periodicity and thus the amount of pressure built up at the area indicated at 506, which can in turn influence the amplitude of a pressure pulse. Also visible in this figure is an O-ring seal 510 that helps ensure that the pressurized fluid in the area indicated at 506 does not bypass the pulsing mechanism 310.

Figure 6:
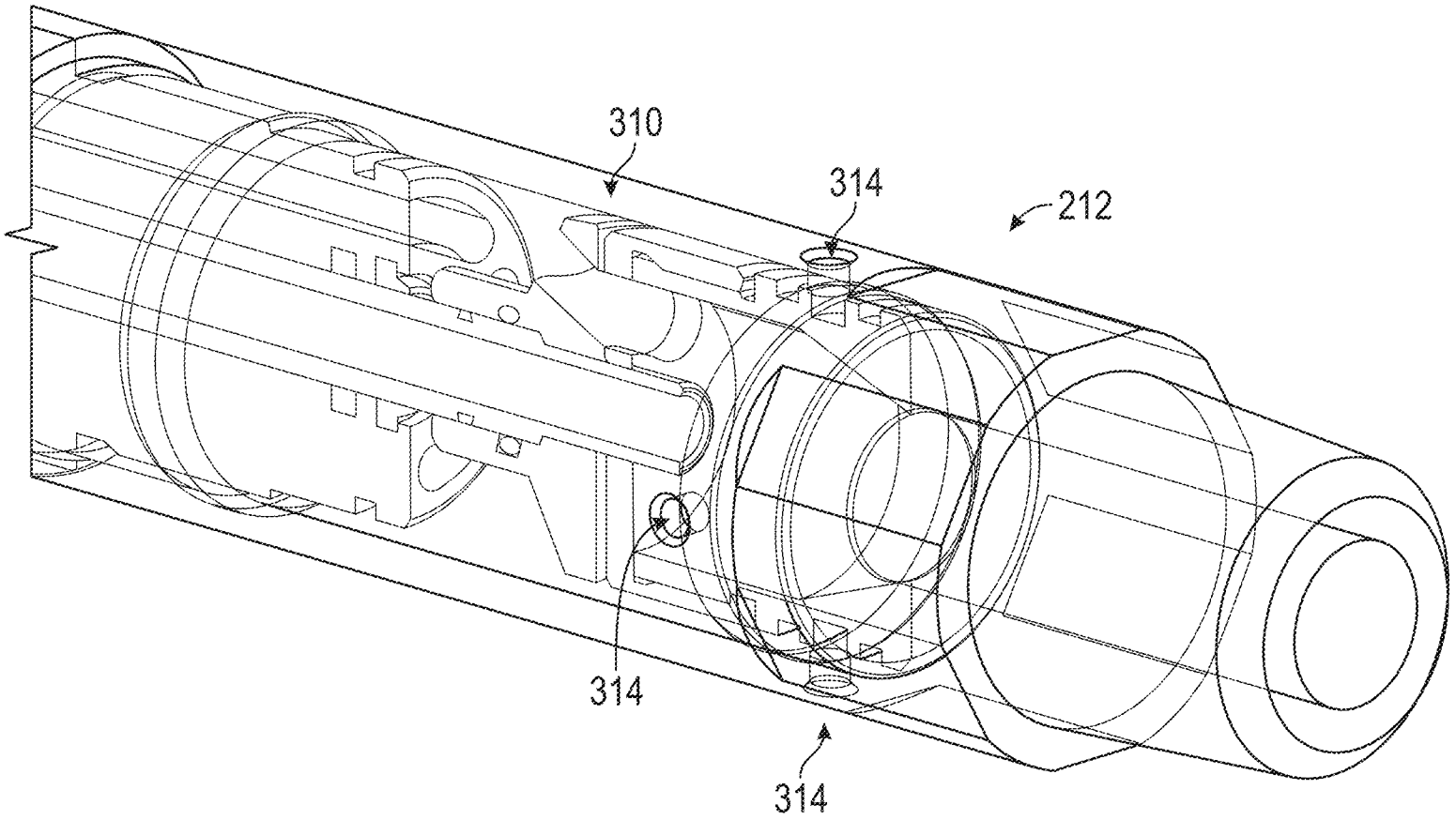
FIG. 6 shows a partially transparent view of the merging sub, in accordance with some embodiments of the present disclosure.

FIG. 6 is a partially transparent view of the merging sub 212, in accordance with some embodiments of the present disclosure. This figure shows example placement locations of the discharge ports 314 downhole from the pulsing mechanism 310. While this figure shows three discharge ports 314, any suitable number is possible, such as any number between 1 and 100, or any ranges therebetween. Likewise, the specific placement of the individual discharge ports 314 may vary without departing from the scope and spirit of the disclosure.

Figure 7A:
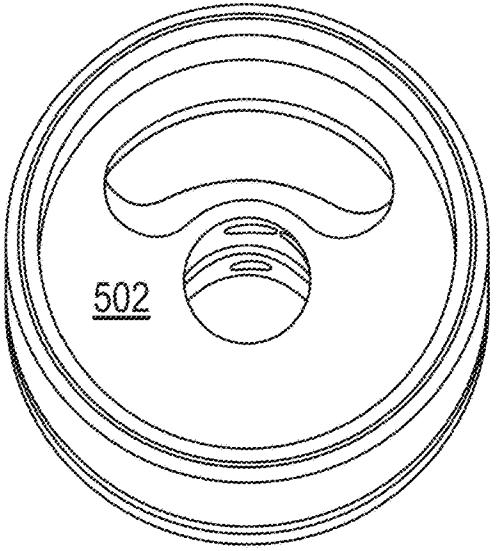
FIG. 7A shows an uphole view of the rotary disc and stationary disc shown in FIGS. 5A, 5B, in an aligned position, in accordance with some embodiments of the present disclosure.
Figure 7B:
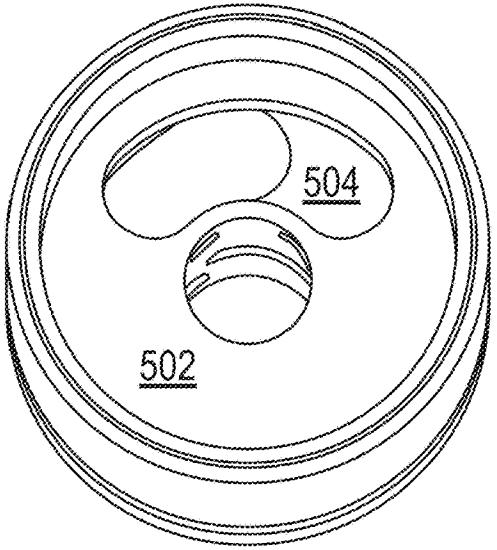
FIG. 7B shows the uphole view shown in FIG. 7A, but with the rotary disc and stationary disc in a partially aligned configuration, in accordance with some embodiments of the present disclosure.
Figure 7C:
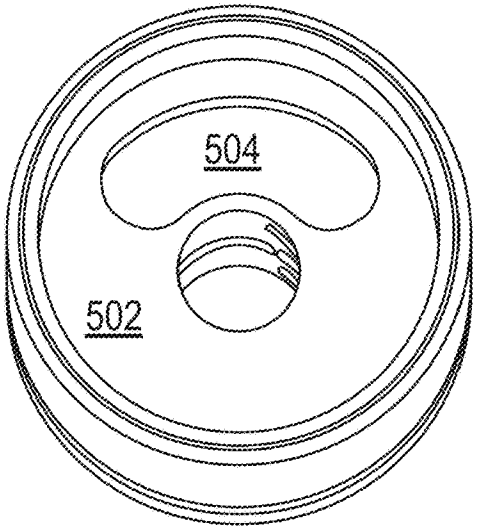
FIG. 7C shows an uphole view of FIGS. 7A and 7B, but with the rotary disc and stationary disc in an unaligned configuration, in accordance with some embodiments of the present disclosure.

FIG. 7A shows an uphole view of the rotary disc 504 and stationary disc 502 shown in FIGS. 5A, 5B, in an aligned position, in accordance with some embodiments of the present disclosure. FIG. 7B shows the uphole view shown in FIG. 7A, but with the rotary disc 504 and stationary disc 502 in a partially aligned configuration, in accordance with some embodiments of the present disclosure. FIG. 7C shows an uphole view of FIGS. 7A and 7B, but with the rotary disc 504 and stationary disc 502 in an unaligned configuration, in accordance with some embodiments of the present disclosure.

Figure 8A:
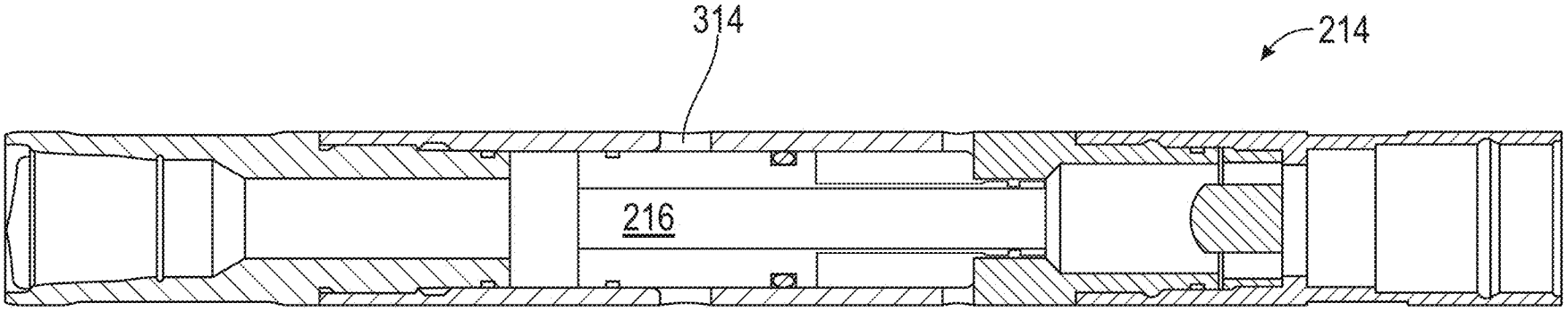
FIG. 8A shows a cross-sectional view of the discharge sub shown in FIG. 3C, with the shifting sleeve in a closed position over the discharge ports of FIG. 8B, in accordance with some embodiments of the present disclosure.
Figure 8B:
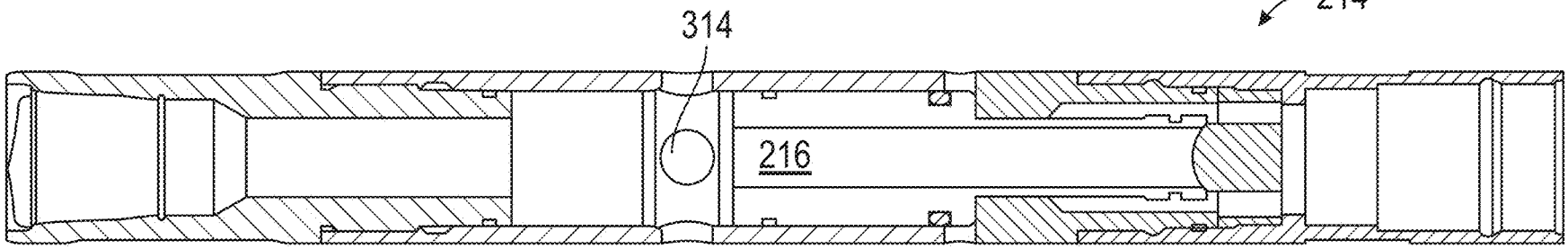
FIG. 8B shows a cross-sectional view of the discharge sub of FIG. 8A, but with the shifting sleeve open to allow fluid communication through the discharge ports, in accordance with some embodiments of the present disclosure.

FIG. 8A is a cross-sectional view of the discharge sub 214 shown in FIG. 3C, with the shifting sleeve 216 in a closed position over the discharge ports 314 (e.g., referring to FIG. 8B), in accordance with some embodiments of the present disclosure. FIG. 8B is the cross-sectional view of the discharge sub of FIG. 8A, but with the shifting sleeve 216 open to allow fluid communication through the discharge ports, in accordance with some embodiments of the present disclosure.

The threshold pressure rating of the shifting sleeve 216 is set above the maximum fluid pressure at which the wash tool 218 (e.g., referring to FIG. 2) operates to avoid the shifting sleeve 216 from activating during normal operation of the wash tool 218. In one or more embodiments, the shifting sleeve 216 may include one or more shear pins (not shown) that are designed to shear when pressure inside the discharge sub 214 increases beyond the threshold pressure rating of the shifting sleeve 216. The shifting sleeve 216 may be configured to open in response to the one or more shear pins shearing.

In one or more embodiments, when the wash tool 218 has finished cleaning the perforations 140, the pumping rate of the low viscosity cleaning fluid (e.g., acid, brine etc.) used to clean the perforations 140 may be significantly increased to increase the fluid pressure in discharge sub 214 beyond the rated threshold pressure of the shifting sleeve 216 and thus opening the shifting sleeve 216 to allow fluids to exit through the discharge ports 314. In alternative embodiments, when the wash tool 218 has finished cleaning the perforations 140, cement slurry may be pumped into the downhole tool assembly 110. Since the shifting sleeve 216 is closed at this point, the cement flow is unable to exit via the discharge ports 314 and proceeds to the wash tool 218 and attempts to exit via the discharge ports 314 of the wash tool 218. However, discharge ports 314 (and in some cases, the wash tool 218 itself) are not designed to pass a high viscosity fluid such as cement. For example, discharge ports 314 are sized to allow passing of lower viscosity fluids only such as brine and acid. The discharge ports 314 are not sufficiently large to allow a high viscosity fluid to pass freely through the discharge ports 314. Thus, the cement is unable to freely exit from the discharge ports 314 of the wash tool 218 which leads to cement pressure building up in the discharge sub 214. With more cement flowing into the downhole tool assembly 110, cement pressure in the discharge sub 214 eventually rises beyond the rated threshold pressure of the shifting sleeve 216 thus opening the shifting sleeve 216 to allow the cement to exit through the discharge ports 314.

Figure 9:
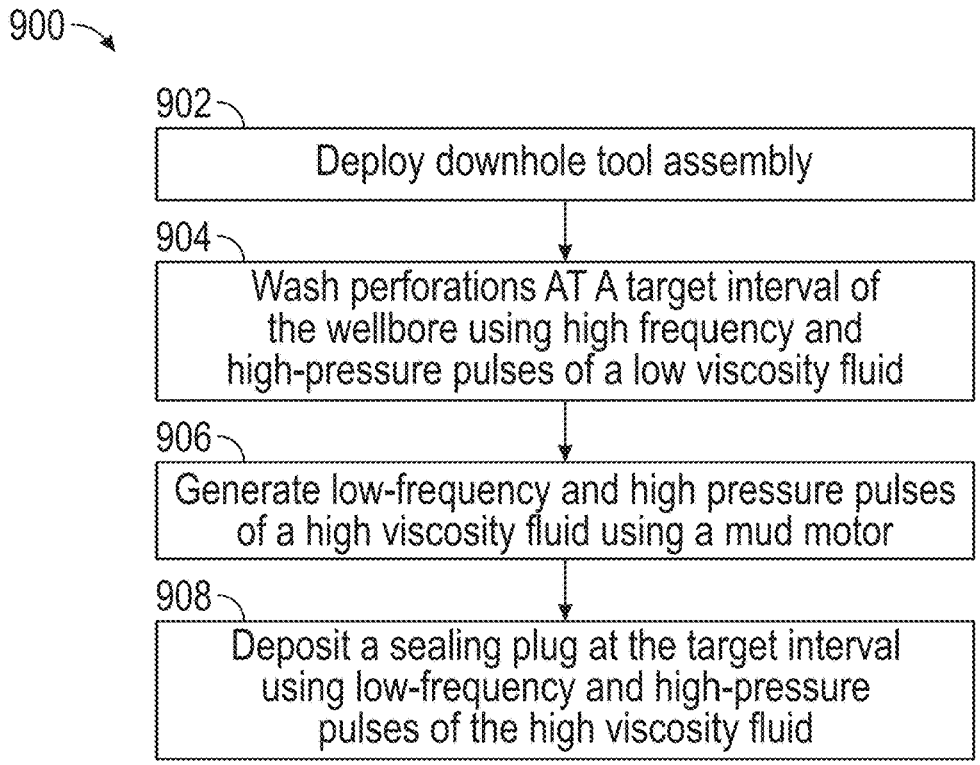
FIG. 9 shows an example of a workflow for operating a downhole tool assembly, in accordance with some embodiments of the present disclosure.

FIG. 9 shows an example of a workflow 900 for operating a downhole tool assembly (e.g., downhole tool assembly 110 of FIG. 1), in accordance with some embodiments of the present disclosure. The workflow 900 begins at 902 by deploying the downhole tool assembly 110 within the wellbore 108. This may be performed using, e.g., coiled tubing, jointed pipe, or other suitable system capable of deploying the downhole tool assembly 110 within the wellbore 108. At 904, the wash tool 218 washes the target interval 114 of the wellbore 108 with pulses of a first fluid (e.g., a low viscosity fluid such as acid and/or brine) at a first frequency (e.g., 100

Hz to 300 Hz, or any ranges therebetween) and a first pressure (e.g., 100 psi to 800 psi, or any ranges therebetween). Wash tool 218 may use fluid oscillator technology to clean debris from perforations or slots 140 in the casing 116 in order to prepare the target interval 114 for the cementing process associated with installing the cement plug. For example, the wash tool 218 may jet oscillating water, brine, spotting acid, solvent, or other low viscosity cleaning agents at the target interval 114 to remove any perforating debris or material buildup away from the target interval 114. By removing the debris and buildup from the target interval 114, sealing communication between the cement plug and the formation 104 may be improved. In examples, after a perforating or slotting operation is completed by a perforating or slotting tool, a low viscosity fluid such as brine or acid may be pumped through the downhole tool assembly 110 and diverted to one or more oscillating side ports of the wash tool 218 to transmit fluid into wellbore 108 in an oscillating manner and thus flush the perforations in the casing 116.

At 906, the pulsing tool 200 generates pulses of a second fluid (e.g., high viscosity fluid such as a cement slurry) at a second frequency (e.g., 5 hertz to 20 hertz, or any ranges therebetween) and a second pressure (e.g., 800 psi to 6000 psi, or any ranges therebetween). The second frequency may be lower than the first frequency generated by the wash tool 218. The second pressure may be higher than the first pressure of the wash tool 218. As discussed, generating the pressure pulses with the pulsing tool 200 may use the natural periodicity induced by the rotation of a suitable rotary mechanism, e.g., a positive displacement pump. Cement may thus permeate into the perforated casing and effectively seal the formation as it is pulsed by the pulsing tool 200.

At 908, the pulsing tool deposits a sealing plug at the target interval 114 using the low frequency and high pressure pulses of the high viscosity fluid. The sealing plug 150 cures to form a hardened solid that isolates the regions above and below the scaling plug 150.

A low frequency may be, for example, between 5 and 20 hertz, or any ranges therebetween. A high frequency may be, for example, between 100 hertz and 300 hertz, or any ranges therebetween. A high viscosity fluid may be, for example, a fluid having a viscosity greater than 120 centipoise (cp). Alternatively, from about 100 cp to about 150 cp, about 150 cp to about 200 cp, about 200 cp to about 250 cp, or any ranges therebetween. A low viscosity fluid may be, for example, a fluid having a viscosity less than 120 cp. Alternatively, from about 30 cp to 120 cp, or any ranges therebetween. A high density fluid may be, for example, between 13 pounds per gallon and 16 pounds per gallon, or any ranges therebetween. A low density fluid may be, for example, less than 13 pounds per gallon, e.g., between 3 pounds per gallon and 13 pounds per gallon, or any ranges therebetween. A fluid that is "high density and/or high viscosity" means that the fluid has either or both a high density and a high viscosity. In some examples, a fluid pulsed by pulsing mechanism 310 (e.g., referring to FIG. 3) may be high density and/or high viscosity. In some examples, a fluid pulsed by wash tool 218 may be low density and/or low viscosity, e.g., relative to fluid pulsed by pulsing mechanism 310.

Figure 10:
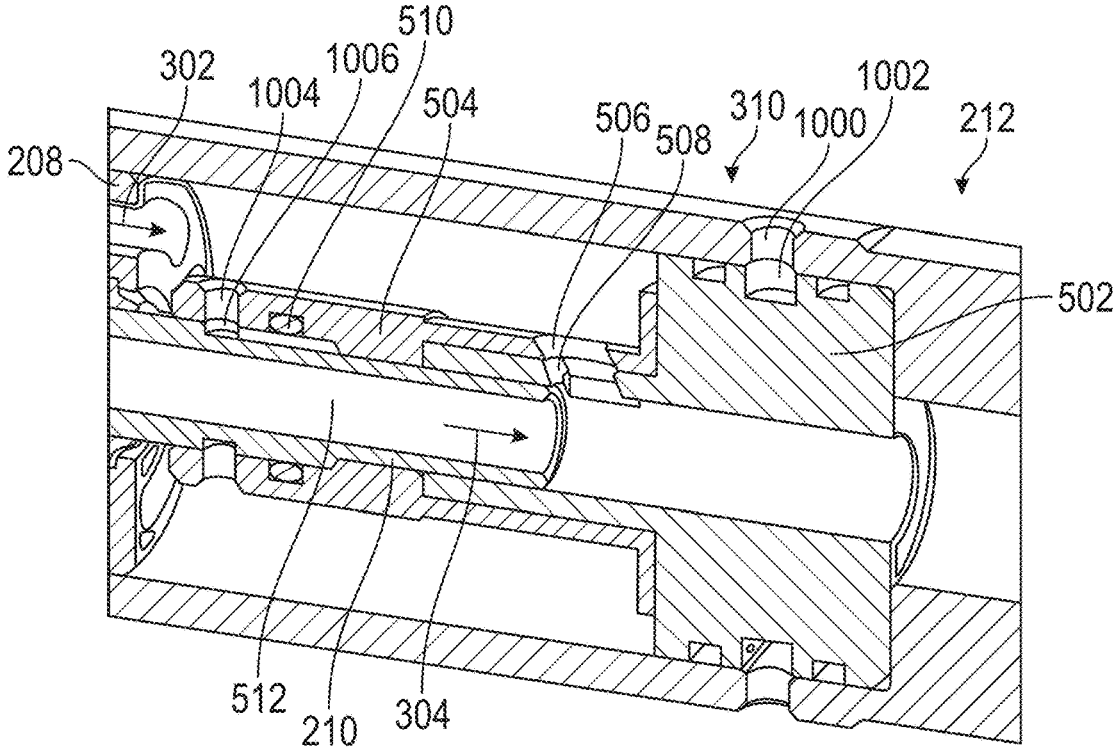
FIG. 10 shows perspective cross-sectional view of a pulsing mechanism, in accordance with some embodiments of the present disclosure.

FIG. 10 shows perspective cross-sectional view of a pulsing mechanism 310, in accordance with some embodiments of the present disclosure. Pulsing mechanism 310 comprises a stationary disc 502 and a rotary disc 504. The rotary disc 504 is fixedly attached to the rotary shaft 210, and comprises a window 506 (e.g., pass-through, port, aperture, channel, etc.). Stationary disc 502 likewise comprises a window 508 that may periodically align with window 506 due to the rotation of rotary shaft 210. As the rotation originates from the positive displacement motor 204 (e.g., referring to FIG. 2), the periodicity that is used to generate the pulses therefore originates from the passage of fluid through the positive displacement motor.

Stationary disc 502 comprises a window 508 that remains stationary during the periodic pressure pulsing with the pulsing mechanism 310. Stationary disc 502 is shown as having a single window (e.g., window 508) but may comprise a plurality, in some examples. Window 508 of stationary disc 502, as well as a corresponding window 506 of a rotary disc 504, may be custom window cutout(s) that allow the bypass stream 302 from the bypass sub 208 to periodically communicate with the region outside the downhole tool assembly 110 (e.g., referring to FIG. 1B) when they are aligned. Stationary disc 502 controls the flow rate of the bypass stream 302 through the merging sub 212 when rotary disc 504 periodically aligns with it. As the rotary disc 504 rotates, the custom window cutout of the rotary disc 504 aligns with the custom window cutout of the stationary disc 502 to allow a flow path for fluid. Prior to the alignment, fluid from the bypass stream 302 may not pass through the two discs. As such, the fluid is held in the bypass sub 208 until alignment occurs. As this process of controlling the flow rate of fluid occurs, cement pulses are generated when alignment occurs and the bypass stream of fluid merges with the non-bypass stream 304 of fluid in the merging sub 212. This figure also shows an inner conduit 512 of rotary shaft 210, previously mentioned, which may allow the non-bypass stream 304 from the positive displacement motor 204 (e.g., referring to FIG. 2) to communicate with the merging sub 212.

A rotary disc 504 is a disc that rotates around the rotary shaft 210. As with the stationary disc 502, the rotary disc 504 may have one or more custom window cutouts to allow the flow path of the bypass stream of fluid from the bypass sub 208. In some embodiments, the window opening size and shape can be adjusted to modify or maximize pulse magnitude at a given flow rate. For example, larger windows may affect the amplitude of a compression wave. Furthermore, the number of windows may also affect the pulse rate and thus the amplitude, as can the rotation speed of the rotary shaft 210, which is fixedly coupled to the rotary disc 504. The rotary shaft 210 is not coupled to the stationary disc 502, however, but freely rotates within pulsing mechanism 310.

Also visible in this figure is an O-ring seal 510 that ensures that the pressurized fluid in the area indicated at 506 does not bypass the pulsing mechanism 310. In addition, bores 1000, 1004 may be disposed within the rotary disc 504 and the outer body of the downhole tool 110 (e.g., referring to FIG. 1) to allow for placement of, e.g., set screws therethrough to fixedly secure ports 1002, 1006, respectively, thereto.

Figure 11A:
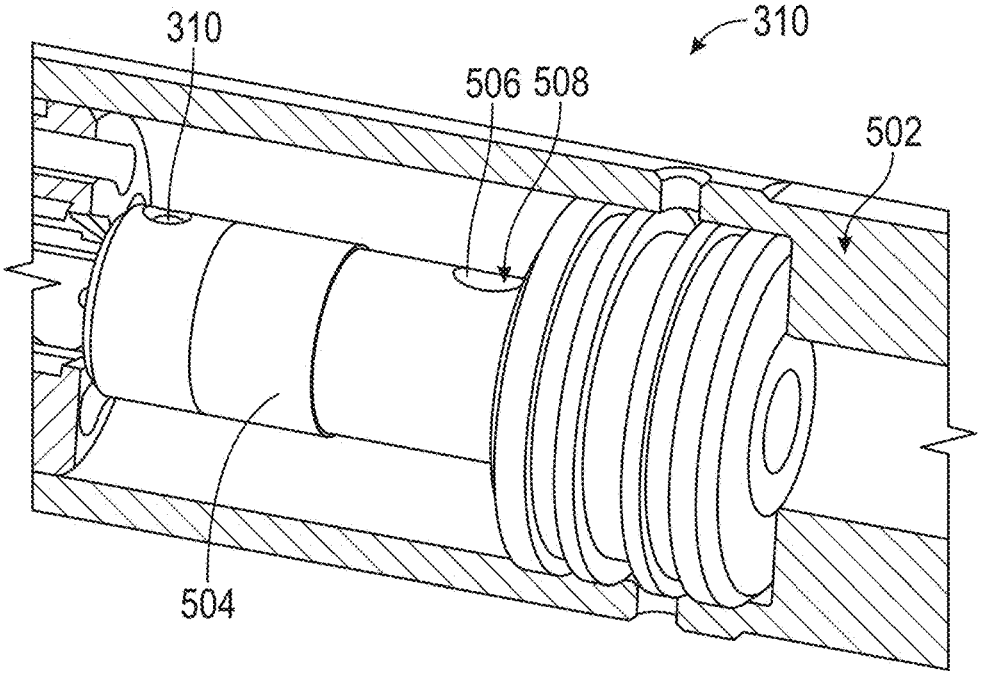
FIG. 11A shows a perspective partially cross-sectional view of the pulsing mechanism of FIG. 10 with the windows of the stationary disc and the rotary disk in an aligned configuration, in accordance with some embodiments of the present disclosure.

FIG. 11A shows a perspective partially cross-sectional view of the pulsing mechanism 310 of FIG. 10 with the windows 506, 508 of the stationary disc 502 and the rotary disk 504 in an aligned configuration, in accordance with some embodiments of the present disclosure. Here and in FIG. 10, in contrast to the embodiments shown and described in FIGS. 5A and 5B, the section of the rotary disc 504 that has window 506 is concentrically disposed about the section of the stationary disc 502 that has window 508 such that a respective interface between windows 506, 508 is parallel to a central axis of downhole tool assembly 110 (e.g., referring to FIG. 1).

Figure 11B:
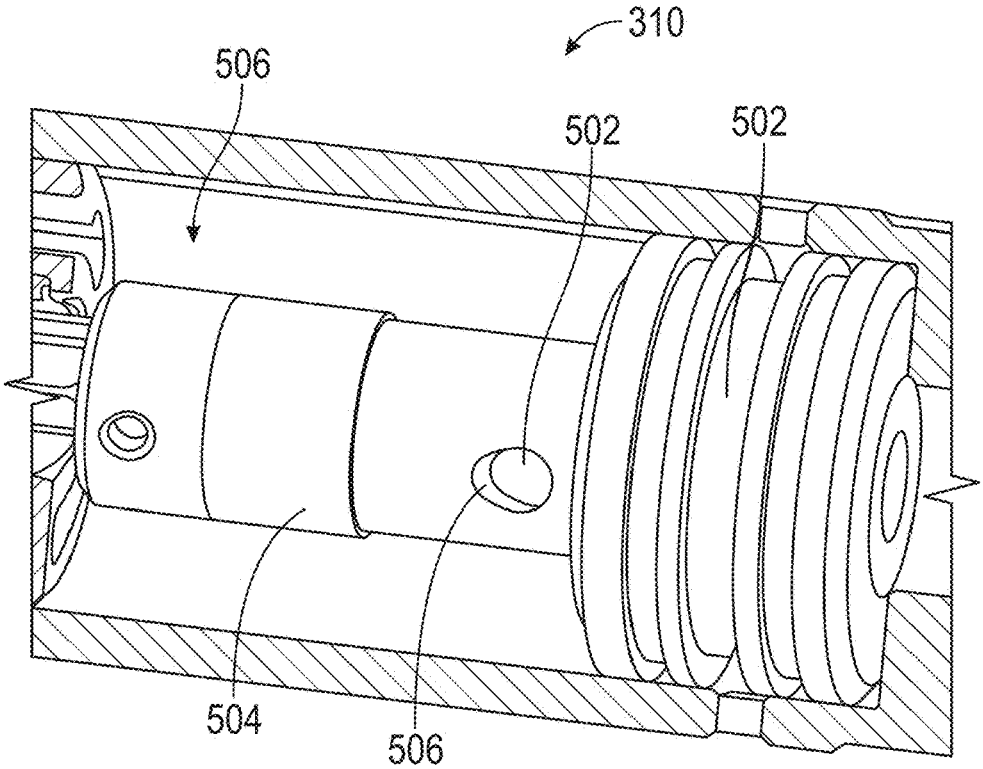
FIG. 11B shows a perspective partially cross-sectional view of the pulsing mechanism of FIG. 11A, but with the windows of the stationary disc and the rotary disk in an unaligned configuration, in accordance with some embodiments of the present disclosure.

FIG. 11B shows a perspective partially cross-sectional view of the pulsing mechanism 310 of FIG. 11A, but with the windows 506, 508 of the stationary disc 502 and the rotary disk 504 in an unaligned configuration, in accordance with some embodiments of the present disclosure. As shown, pressure may build up at the region indicated at 506 due to the impasse created by the nonalignment of the stationary disc 502 and the rotary disc 504, e.g., as seen by an outer tubular surface of rotary shaft 210 visible through window 506. This built-up pressure is discharged periodically each time the windows 506 and 508 (e.g., referring also to FIG. 11A) align. The pressure of bypass stream 302 (e.g., referring to FIG. 3B) may therefore asymptotically approach that of a downgoing fluid that originally enters fluid divider 202 (e.g., referring to FIG. 3A). Rotation rate of rotary shaft 210 may also affect the periodicity and thus the amount of pressure built up at the area indicated at 506, which can in turn influence the amplitude of a pressure pulse.

Figure 12A:
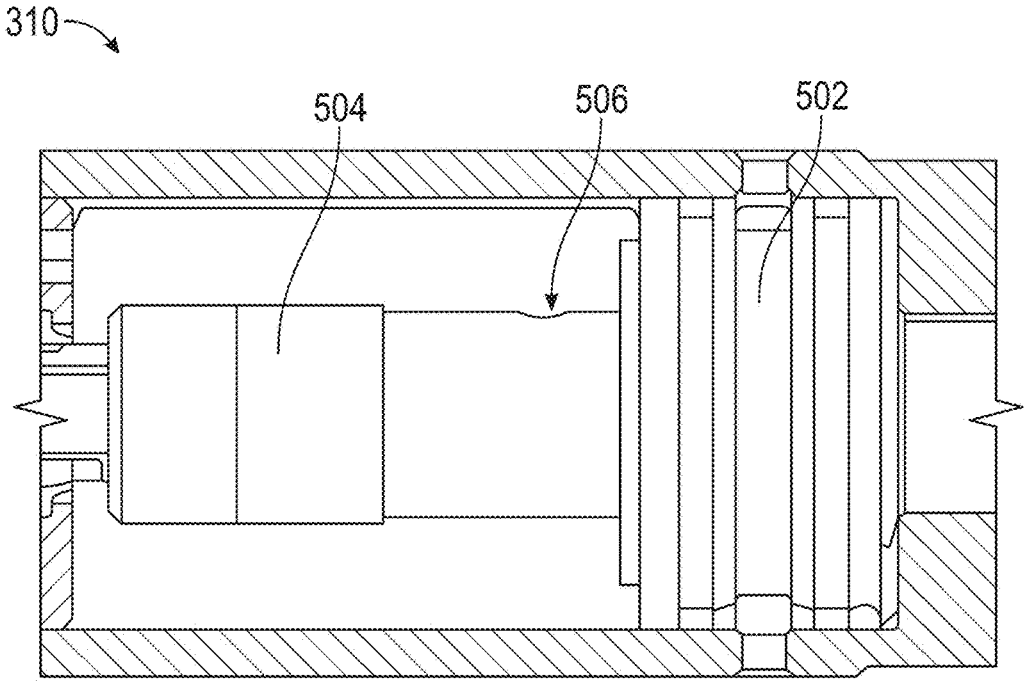
FIG. 12A shows a partially cross-sectional view of the pulsing mechanism of FIG. 11A, in accordance with some embodiments of the present disclosure.
Figure 12B:
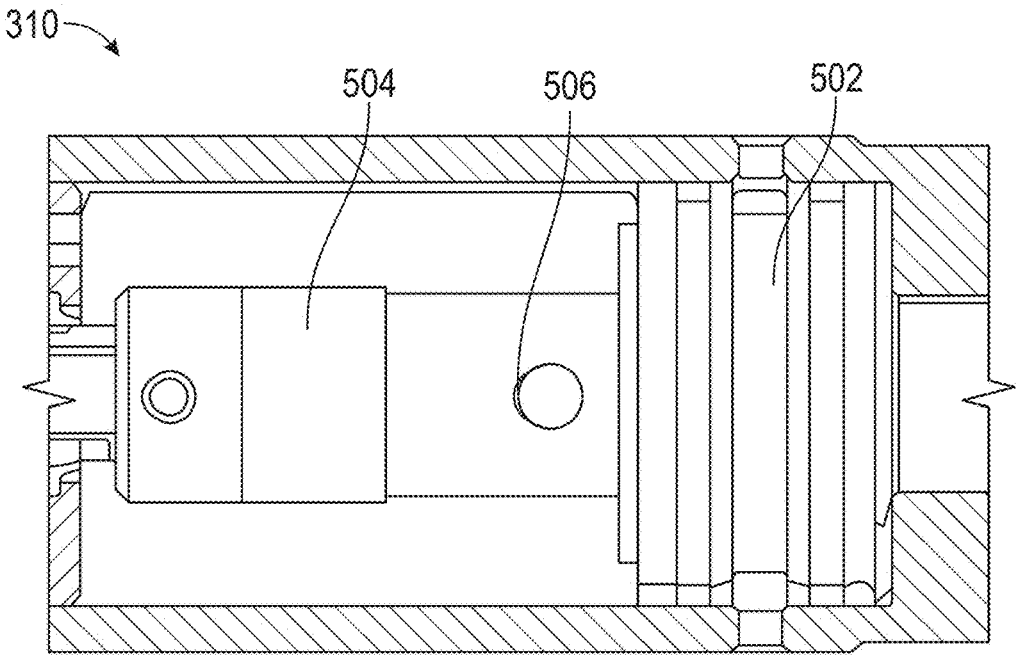
FIG. 12B shows a partially cross-sectional view of the pulsing mechanism of FIG. 11B, in accordance with some embodiments of the present disclosure.

FIG. 12A shows a partially cross-sectional view of the pulsing mechanism 310 of FIG. 11A, in accordance with some embodiments of the present disclosure. FIG. 12B shows a partially cross-sectional view of the pulsing mechanism 310 of FIG. 11B, in accordance with some embodiments of the present disclosure. As shown, rotary disc 504 rotates with respect to stationary disc 502 to periodically align aperture 506 with a corresponding aperture (not shown) of stationary disc 502 to thereby allow pressurized fluid to discharge through one or more downhole ports (e.g., discharge ports 314 of FIG. 6) to pressure pulse a fluid during a plugging operation.

Accordingly, the present disclosure may provide a downhole tool assembly that uses a rotary mechanism to generate pulses during plugging operations in a wellbore. The methods and system may include any of the various features disclosed herein, including one or more of the following statements.

Statement 1: A downhole tool assembly, comprising: a rotary mechanism; a pulsing mechanism, comprising: a rotary disc in mechanical communication with the rotary mechanism, wherein a window of the rotary disc is configured to periodically align with a corresponding window of the downhole tool assembly to generate a pressure pulse based on a periodicity of the rotary mechanism; and a discharge port configured to discharge a fluid as the fluid is being pulsed by the pulsing mechanism.

Statement 2: The downhole tool assembly of statement 1, wherein the fluid comprises cement slurry.

Statement 3: The downhole tool assembly of statements 1 or 2, further comprising: a fluid divider uphole from the rotary mechanism to separate a downgoing stream into a bypass stream and a non-bypass stream, wherein the non-bypass stream is configured to drive a rotation of the rotary mechanism, wherein the pressure pulse originates from a periodic combination of pressure differentials associated with the bypass stream and the non-bypass stream, and wherein the rotary disc is in mechanical communication with a tortuous rotor of the rotary mechanism via a double universal joint and a rotary shaft.

Statement 4: The downhole tool assembly of any of statements 1-3, further comprising a wash tool.

Statement 5: The downhole tool assembly of any of statements 1-4, further comprising: a merging sub configured to combine a bypass stream and a non-bypass stream; and a shifting sleeve downhole from the rotary mechanism.

Statement 6: The downhole tool assembly of any of statements 1-5, further comprising a rotary shaft affixed to the pulsing mechanism.

Statement 7: The downhole tool assembly of any of statements 1-6, wherein the rotary mechanism comprises a positive displacement pump, wherein a center point for a given cross section of a tortuous rotor is offset from a centerline of the positive displacement pump.

Statement 8: The downhole tool assembly of any of statements 1-7, wherein the rotary mechanism comprises a turbine, a mud motor, or an electric motor.

Statement 9: The downhole tool assembly of any of statements 1-8, wherein the windows of the rotary disc and a stationary disc are configured parallel to, or perpendicular to, a central axis of the downhole tool assembly.

Statement 10: A method, comprising: introducing a downhole tool assembly into a wellbore extending into a subterranean formation; discharging a fluid into the target interval of the wellbore with the downhole tool assembly; and pulsing the fluid as it is being discharged, wherein a periodicity of the pulsing is based on a rotation rate of a rotary mechanism forming part of the downhole tool assembly.

Statement 11: The method of statement 10, further comprising: perforating the wellbore with the downhole tool assembly; washing a perforated section of the wellbore with a wash tool of the downhole tool assembly; and after washing, plugging the perforated section of the wellbore with the pulsed fluid.

Statement 12: The method of statements 10 or 11, wherein the pulsed fluid comprises a plugging composition.

Statement 13: The method of any of statements 10-12, further comprising dividing a downgoing fluid into a bypass stream and a non-bypass stream, wherein the non-bypass stream drives rotation of the rotary mechanism, wherein the fluid is pulsed at a frequency between 5 and 20 hertz, wherein the fluid has a viscosity greater than 120 centipoise, and wherein a combined pressure drop of the bypass stream and the non-bypass stream initiates the pulsing of the fluid.

Statement 14: The method of any of statements 10-13, wherein the periodicity is based on a periodic alignment of corresponding windows of a rotation disc and a stationary disc.

Statement 15: The method of any of statements 10-14, further comprising introducing brine and/or acid into the wellbore through the downhole tool assembly; and after washing a target interval of the wellbore with a wash tool, opening one or more discharge ports of a discharge sub, wherein the opening is achieved by increasing a hydrostatic pressure of the fluid within the downhole tool assembly.

Statement 16: The method of any of statements 10-15, wherein windows of the rotary mechanism are configured parallel to, or perpendicular to, a central axis of the downhole tool assembly.

Statement 17: A downhole tool assembly, comprising: a divider to separate a downgoing stream into at least a bypass and a non-bypass stream; a positive displacement motor, wherein movement of the non-bypass stream is configured to rotate a tortuous rotor of the positive displacement motor; a pulsing mechanism, comprising: a stationary disc; and a rotary disc in mechanical communication with the positive displacement motor, wherein a window of the rotary disc is configured to periodically align with a corresponding window of the stationary disc to generate a pressure pulse; a merging sub configured to combine the bypass and the non-bypass stream at the pulsing mechanism; a discharge sub configured to discharge the fluid as it is being pulsed by the pulsing mechanism; and a shifting sleeve configured to uncover one or more discharge ports of the discharge sub when a threshold pressure within the discharge sub is met.

Statement 18: The downhole tool assembly of statement 17, further comprising a wash tool downhole from the discharge sub.

Statement 19: The downhole tool assembly of statements 17 or 18, further comprising a rotary shaft in mechanical communication with the positive displacement motor via a universal joint.

Statement 20: The downhole tool assembly of any of statements 17-19, wherein the one or more discharge ports comprise at least three discharge ports.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool assembly, comprising:

a rotary mechanism;

a rotary shaft in mechanical communication with the rotary mechanism and a rotary disc attached to the rotary shaft, wherein the rotary shaft defines a first flow path for a first stream in an inner conduit of the rotary shaft and another flow path for a second stream radially disposed around the rotary shaft;

a pulsing mechanism, comprising:

the rotary disc in mechanical communication with the rotary mechanism, wherein a window of the rotary disc is configured to periodically align with a corresponding window of the downhole tool assembly to generate a pressure pulse based on pressure drop of the first stream of fluid through the rotary shaft and a periodicity of the rotary mechanism, and wherein the rotary disc is configured to block a flow of the second stream along the second flow path when the window of the rotary disc is not aligned with the corresponding window of the downhole tool assembly; and a discharge port configured to discharge a fluid as the fluid is being pulsed by the pulsing mechanism.

2. The downhole tool assembly of claim 1, wherein the fluid comprises cement slurry.

3. The downhole tool assembly of claim 1, further comprising:

a fluid divider uphole from the rotary mechanism to separate a downgoing stream into the first stream and the second stream, wherein the first stream is configured to drive a rotation of the rotary mechanism, wherein the pressure pulse originates from the pressure drop through the rotary shaft and a periodic increase/decrease of pressure associated with the second stream, and wherein the rotary disc is in mechanical communication with a tortuous rotor of the rotary mechanism via a double universal joint and a rotary shaft.

4. The downhole tool assembly of claim 1, further comprising a wash tool.

5. The downhole tool assembly of claim 1, further comprising:

a merging sub configured to combine a bypass stream and a non-bypass stream; and a shifting sleeve downhole from the rotary mechanism.

6. The downhole tool assembly of claim 1, further comprising a rotary shaft affixed to the pulsing mechanism.

7. The downhole tool assembly of claim 1, wherein the rotary mechanism comprises a positive displacement pump, wherein a center point for a given cross section of a tortuous rotor is offset from a centerline of the positive displacement pump.

8. The downhole tool assembly of claim 1, wherein the rotary mechanism comprises a turbine, a mud motor, or an electric motor.

9. The downhole tool assembly of claim 1, wherein the windows of the rotary disc and a stationary disc are configured parallel to, or perpendicular to, a central axis of the downhole tool assembly.

10. A method, comprising:

introducing a downhole tool assembly into a wellbore extending into a subterranean formation;

discharging a fluid into the target interval of the wellbore with the downhole tool assembly, the downhole tool assembly comprising:

a rotary shaft in mechanical communication with a rotary mechanism and a rotary disc attached to the rotary shaft, wherein the rotary shaft defines a first flow path for a first stream of the fluid in an inner conduit of the rotary shaft and a second flow path for a second stream of the fluid radially disposed around the rotary shaft;

blocking a flow of the second stream of fluid along the second flow path when a window of the rotary disc is not aligned with a corresponding window of the downhole tool assembly; and pulsing the fluid as it is being discharged, wherein a periodicity of the pulsing is based on a rotation rate of the rotary mechanism and a pressure drop of the first stream of the fluid through the rotary shaft.

11. The method of claim 10, further comprising:

perforating the wellbore with the downhole tool assembly;

washing a perforated section of the wellbore with a wash tool of the downhole tool assembly; and after washing, plugging the perforated section of the wellbore with the pulsed fluid.

12. The method of claim 10, wherein the pulsed fluid comprises a plugging composition.

13. The method of claim 10, further comprising dividing the fluid into the first stream of the fluid and the second stream of the fluid, wherein the stream drives rotation of the rotary mechanism, wherein the fluid is pulsed at a frequency between 5 and 20 hertz, wherein the fluid has a viscosity greater than 120 centipoise, and wherein an increase/decrease of pressure associated with the second stream of the fluid and the first stream of the fluid initiates the pulsing of the fluid.

14. The method of claim 10, wherein the periodicity is based on a periodic alignment of the window of the rotary disc and the corresponding window of the downhole tool assembly, wherein the corresponding window of the downhole tool assembly is disposed on a stationary disc of the downhole tool assembly.

15. The method of claim 10, further comprising introducing brine and/or acid into the wellbore through the downhole tool assembly; and after washing a target interval of the wellbore with a wash tool, opening one or more discharge ports of a discharge sub, wherein the opening is achieved by increasing a hydrostatic pressure of the fluid within the downhole tool assembly.

16. The method of claim 10, wherein the window of the rotary disc and the corresponding window of the downhole tool assembly are configured parallel to, or perpendicular to, a central axis of the downhole tool assembly.

17. A downhole tool assembly, comprising:

a divider to separate a downgoing stream into at least a bypass and a non-bypass stream;

a positive displacement motor, wherein movement of the non-bypass stream is configured to rotate a tortuous rotor of the positive displacement motor, wherein the positive displacement motor is configured to:

define a first flow path for the non-bypass stream in an inner conduit of the positive displacement motor and a second flow path for the bypass stream radially disposed around the positive displacement motor;

a pulsing mechanism, comprising:

a stationary disc; and a rotary disc in mechanical communication with the positive displacement motor, wherein a window of the rotary disc is configured to periodically align with a corresponding window of the stationary disc to generate a pressure pulse based on a pressure drop of the non-bypass stream through the inner conduit and a periodicity of the tortuous rotor, and wherein the rotary disc is configured to block a flow of the bypass stream when the window of the rotary disc does not align with the corresponding window of the stationary disc;

a merging sub configured to combine the bypass and the non-bypass stream at the pulsing mechanism;

a discharge sub configured to discharge the fluid as it is being pulsed by the pulsing mechanism; and a shifting sleeve configured to uncover one or more discharge ports of the discharge sub when a threshold pressure within the discharge sub is met.

18. The downhole tool assembly of claim 17, further comprising a wash tool downhole from the discharge sub.

19. The downhole tool assembly of claim 17, further comprising a rotary shaft in mechanical communication with the positive displacement motor via a universal joint.

20. The downhole tool assembly of claim 17, wherein the one or more discharge ports comprise at least three discharge ports.

* * * * *